US008592113B2

(12) United States Patent
Watanabe et al.

(10) Patent No.: US 8,592,113 B2
(45) Date of Patent: Nov. 26, 2013

(54) TONER, METHOD OF MANUFACTURING TONER, DEVELOPER, AND IMAGE FORMING METHOD

(75) Inventors: Masaki Watanabe, Numazu (JP); Hiroshi Yamashita, Namazu (JP); Tomoh Kubo, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 361 days.

(21) Appl. No.: 12/899,057

(22) Filed: Oct. 6, 2010

(65) Prior Publication Data

US 2011/0086305 A1 Apr. 14, 2011

(30) Foreign Application Priority Data

Oct. 8, 2009 (JP) ..... 2009-234459

(51) Int. Cl.
*G03G 9/08* (2006.01)

(52) U.S. Cl.
USPC ..... 430/108.1; 430/108.2; 430/108.4; 430/137.22

(58) Field of Classification Search
USPC ..... 430/108.1–108.4
See application file for complete search history.

(56) References Cited

U.S. PATENT DOCUMENTS 5,952,145 A * 9/1999 Yamanaka et al. ..... 430/108.1
7,074,541 B2 7/2006 Yamashita et al.
7,364,828 B2 4/2008 Yamashita et al.
2009/0325099 A1* 12/2009 Watanabe et al. ..... 430/108.4
2010/0015544 A1* 1/2010 Agur et al. ..... 430/108.23

FOREIGN PATENT DOCUMENTS

| | | |
|---|---|---|
| JP | 3-34955 | 2/1991 |
| JP | 2899038 | 3/1999 |
| JP | 3073782 | 6/2000 |
| JP | 2003-241416 | 8/2003 |
| JP | 2004-109533 | 4/2004 |
| JP | 3640918 | 1/2005 |
| JP | 3730587 | 10/2005 |
| JP | 2007-249088 | 9/2007 |
| JP | 2010-72037 | 4/2010 |

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A toner including a mother toner comprising a binder resin and a calixarene having a halogen group, and a charge controlling agent having a halogen group that is present on a surface of the mother toner. The ratio of halogen ion to carbon ion on a surface of the toner is from 0.01 to 0.5, when determined by TOF-SIMS. The toner can be prepared by preparing a first liquid by dissolving or dispersing toner components including a calixarene having a halogen group and a binder resin and/or a precursor of the binder resin in an organic solvent; preparing a second liquid by emulsifying or dispersing the first liquid in an aqueous medium; removing the organic solvent from the second liquid; preparing a third liquid by washing the second liquid from which the organic solvent is removed; and adding a charge controlling agent having a halogen group to the third liquid.

18 Claims, 5 Drawing Sheets

TONER, METHOD OF MANUFACTURING TONER, DEVELOPER, AND IMAGE FORMING METHOD

CROSS-REFERENCE TO RELATED APPLICATIONS

The present patent application claims priority pursuant to 35 U.S.C. §119 from Japanese Patent Application No. 2009-234459, filed on Oct. 8, 2009, which is hereby incorporated by reference herein in its entirety.

BACKGROUND

1. Field of the Invention

The present invention relates to a toner, a method of manufacturing toner, a developer, and an image forming method.

2. Description of the Background

In the field of electrophotographic image forming technology, demand for high-quality full-color images is increasing. To meet such demand, toner particles that constitute the toners used to form images are required to be smaller to more precisely reproduce electrostatic latent images. Smaller toner particles have an advantage in dot and line reproducibility, and moreover, they can make the resulting image thinner. Such smaller toner particles are generally obtainable by various polymerization processes.

Japanese Patent Application Publication No. 03-237468 discloses a toner including a p-phenyl calix(n)arene compound as a charge controlling agent.

However, there is a problem in that such a charge controlling agent is likely to decompose and is difficult to disperse when used for a toner manufactured through a polymerization process.

SUMMARY

Exemplary aspects of the present invention are put forward in view of the above-described circumstances, and provide novel toner and developer having good chargeability, durability, and environmental stability, a novel method of manufacturing such a toner, a novel developer including the toner, and an image forming method using the toner.

In one exemplary embodiment, novel toner and developer each include a mother toner comprising a binder resin and a calixarene having a halogen group, and a charge controlling agent having a halogen group that is present on a surface of the mother toner. The ratio of halogen ion to carbon ion on a surface of the toner is from 0.01 to 0.5, when the ratio is determined from number of counts measured by time-of-flight secondary ion mass spectroscopy.

In another exemplary embodiment, a novel method of manufacturing toner includes: preparing a first liquid by dissolving or dispersing toner components in an organic solvent, the toner components including a calixarene having a halogen group and one or both of a binder resin and a precursor of the binder resin; preparing a second liquid by emulsifying or dispersing the first liquid in an aqueous medium; removing the organic solvent from the second liquid; preparing a third liquid by washing the second liquid from which the organic solvent is removed; and adding a charge controlling agent having a halogen group to the third liquid.

In yet another exemplary embodiment, a novel image forming method includes: charging a photoreceptor; emitting light onto the charged photoreceptor to form an electrostatic latent image thereon; developing the electrostatic latent image into a toner image with the above toner; and transferring the toner image from the photoreceptor onto a recording material.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
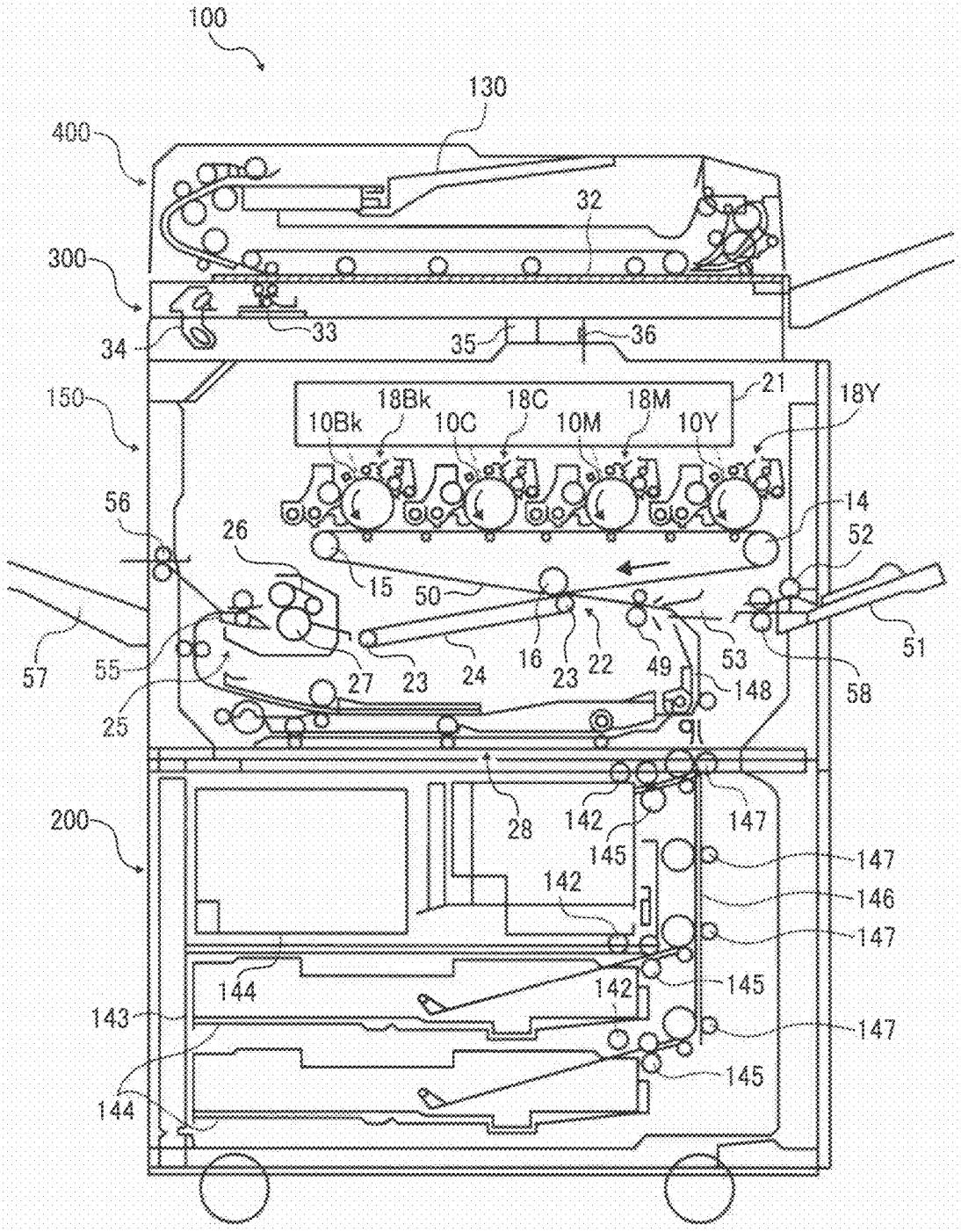
FIG. 1 schematically illustrates a tandem image forming apparatus for practicing the image forming method according to this specification.

The toner according to this specification comprises a mother toner comprising a binder resin and a calixarene having a halogen group, and a charge controlling agent having a halogen group that is present on a surface of the mother toner. The ratio of halogen ion to carbon ion (hereinafter "the relative ion strength X") on a surface of the toner is from 0.01 to 0.5, when the ratio is determined from number of counts measured by time-of-flight secondary ion mass spectroscopy (TOF-SIMS). Such a toner has excellent chargeability, durability, and environmental stability, because both the calixarene having a halogen group and the charge controlling agent having a halogen group control charge of the toner. Even when the toner is manufactured through a polymerization process, the calixarene having a halogen group is not decomposed or adversely affected by other materials present in the mother toner.

When the relative ion strength X is less than 0.01, the toner cannot be charged satisfactorily. When the relative ion strength X is greater than 0.5, the toner is excessively charged, thus increasing an electrostatic attractive force between a developing roller. As a result, fluidity of the toner decreases or the resulting image density deteriorates. Moreover, the surface profile of the toner is roughened, and such a toner contaminates carrier particles when used in a two-component developer. Such a two-component developer cannot keep an appropriate level of charge, and has poor environmental stability.

Specific examples of the calixarene having a halogen group include, but are not limited to, a calixarene having p-trifluoromethoxy group and a calixarene having p-bromophenyl group. Two or more types of such calixarene compounds can be used in combination.

The charge controlling agent having a halogen group may be any compound having a halogen group, other than the calixarene having a halogen group. Two or more types of such charge controlling agents can be used in combination.

The toner preferably includes the calixarene having a halogen group and the charge controlling agent having a halogen group in a total amount of from 0.01 to 0.5% by mass. When the total amount is too small, the toner cannot be charged satisfactorily. When the total amount is too large, the toner is excessively charged, thus increasing an electrostatic attractive force between a developing roller. As a result, fluidity of the toner decreases or the resulting image density deteriorates. Moreover, the surface profile of the toner is roughened, and such a toner contaminates carrier particles when used in a two-component developer. Such a two-component developer cannot keep an appropriate level of charge, and has poor environmental stability.

Specific preferred materials for the binder resin include, but are not limited to, polyester, modified polyester, silicone resin, styrene-acrylic resin, styrene resin, acrylic resin, epoxy resin, diene resin, phenol resin, terpene resin, coumarin resin, amide-imide resin, butyral resin, urethane resin, and ethylene-vinyl acetate resin. Two or more types of such resins can be used in combination. Among these resins, polyester is most preferable because it rapidly melts when fixed on a recording material to smoothen the resulting image surface.

A polyester can be obtained from a polycondensation between a polyol and a polycarboxylic acid.

The polyol is represented by the following formula:

$$A(OH)_m$$

wherein A represents an aliphatic, aromatic, or heteroaromatic group having 1 to 20 carbon atoms and an optional substituent, and m represents an integer of from 2 to 4.

The polycarboxylic acid is represented by the following formula:

$$B(COOH)_n$$

wherein B represents an aliphatic, aromatic, or heteroaromatic group having 1 to 20 carbon atoms and an optional substituent, and n represents an integer of from 2 to 4.

Specific examples of the polyol include, but are not limited to, ethylene glycol, diethylene glycol, triethylene glycol, 1,2-propylene glycol, 1,3-propylene glycol, 1,4-butanediol, neopentyl glycol, 1,4-butenediol, 1,5-pentenediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adduct of bisphenol A, propylene oxide adduct of bisphenol A, hydrogenated bisphenol A, ethylene oxide adduct of hydrogenated bisphenol A, and propylene oxide adduct of hydrogenated bisphenol A. Two or more types of such polyols can be used in combination.

Specific examples of the polycarboxylic acid include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzenetricarboxylic acid, 2,5,7-napthalenetricarboxylic acid, 1,2,4-napthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, cyclohexanedicarboxylic acid, cyclohexenetricarboxylic acid, butanetetracarboxylic acid, diphenyl sulfone tetracarboxylic acid, and ethylene glycol bis(trimellitic acid). Two or more types of such polycarboxylic acids can be used alone or in combination.

A modified polyester can be obtained from a reaction between a compound having an active hydrogen group and a polyester prepolymer having a functional group reactive with the active hydrogen group.

For example, an urea-modified polyester can be obtained from an elongating reaction and/or a cross-linking reaction between a compound having an amino group and a polyester prepolymer having an isocyanate group.

The polyester prepolymer having an isocyanate group can be obtained from a reaction between a polyester having a hydroxyl group and a polyisocyanate. The polyester having a hydroxyl group can be obtained from a polycondensation between a polyol and a polycarboxylic acid.

The polyol may be a diol, an alcohol having 3 or more valences, or a mixture of a diol with an alcohol having 3 or more valences. Two or more types of such polyols can be used in combination. A diol alone, or a mixture of a diol with a small amount of an alcohol having 3 or more valences is preferable.

Specific examples of the diol include, but are not limited to, alkylene glycols (e.g., ethylene glycol, 1,2-propylene glycol, 1,3-propylene glycol, 1,4-butanediol, 1,6-hexanediol), polyalkylene glycols (e.g., diethylene glycol, triethylene glycol, dipropylene glycol, polyethylene glycol, polypropylene glycol, polybutylene glycol), alicyclic diols (e.g., 1,4-cyclohexanedimethanol, hydrogenated bisphenol A), alkylene oxide (e.g., ethylene oxide, propylene oxide, butylene oxide) adducts of alicyclic diols, bisphenols (e.g., bisphenol A, bisphenol F, bisphenol S), and alkylene oxide (e.g., ethylene oxide, propylene oxide, butylene oxide) adducts of bisphenols. Among these diols, an alkylene glycol having 2 to 12 carbon atoms and an alkylene oxide adduct of a bisphenol are preferable; and an alkylene oxide adduct of a bisphenol alone, and a mixture of an alkylene oxide adduct of a bisphenol with an alkylene glycol having 2 to 12 carbon atoms are more preferable.

Specific examples of the alcohol having 3 or more valences include, but are not limited to, aliphatic polyols (e.g., glycerin, trimethylolethane, trimethylolpropane, pentaerythritol, sorbitol), polyphenols (e.g., trisphenol PA from Honshu Chemical Industry Co., Ltd., phenol novolac, cresol novolac), and alkylene oxide (e.g., ethylene oxide, propylene oxide, butylene oxide) adducts of polyphenols.

When a diol and an alcohol having 3 or more valences are used in combination, the weight ratio of the alcohol having 3 or more valences to the diol is preferably from 0.01 to 10, and more preferably from 0.01 to 1.

The polycarboxylic acid may be a dicarboxylic acid, a carboxylic acid having 3 or more valences, or a mixture of a dicarboxylic acid with a carboxylic acid having 3 or more valences. Two or more types of such polycarboxylic acids can be used in combination. A dicarboxylic acid alone, or a mixture of a dicarboxylic acid with a small amount of carboxylic acid having 3 or more valences is preferable.

Specific examples of the dicarboxylic acid include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Among these dicarboxylic acids, alkylene dicarboxylic acids having 4 to 20 carbon atoms and aromatic dicarboxylic acids having 8 to 20 carbon atoms are preferable.

Specific examples of the carboxylic acid having 3 or more valences include, but are not limited to, aromatic polycarboxylic acids (e.g., trimellitic acid, pyromellitic acid). Among these carboxylic acids, aromatic polycarboxylic acids having 9 to 20 carbon atoms are preferable.

Additionally, anhydrides and lower alkyl esters (e.g., methyl ester, ethyl ester, isopropyl ester) of the polycarboxylic acids can also be used in place of the polycarboxylic acids.

When a dicarboxylic acid and a carboxylic acid having 3 or more valences are used in combination, the weight ratio of the carboxylic acid having 3 or more valences to the dicarboxylic acid is preferably from 0.01 to 10, and more preferably from 0.01 to 1.

When preparing the polyester having a hydroxyl group, the equivalent ratio of hydroxyl group in the polyol to carboxylic group in the polycarboxylic acid is preferably from 1 to 2, more preferably from 1 to 1.5, and most preferably from 1.02 to 1.3.

The polyester prepolymer having an isocyanate group preferably includes polyol-origin units in an amount of from 0.5 to 40% by weight, more preferably from 1 to 30% by weight, and most preferably from 2 to 20% by weight. When the amount of polyol-origin units is too small, hot offset resistance, heat-resistant storage stability, and low-temperature fixability of the toner may be poor. When the amount of polyalcohol-origin units is too large, low-temperature fixability of the toner may be poor.

Specific examples of the polyisocyanates include, but are not limited to, aliphatic polyisocyanates (e.g., tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, tetramethylhexane diisocyanate), alicyclic polyisocyanates (e.g., isophorone diisocyanate, cyclohexylmethane diisocyanate), aromatic diisocyanates (e.g., tolylene diisocyanate, diphenylmethane diisocyanate, 1,5-naphthylene diisocyanate, diphenylne-4,4'-diisocyanate, 4,4'-diisocyanato-3,3'-dimethyldiphenyl, 3-methyldiphenylmethane-4,4'-diisocyanate, diphenyl ether-4,4'-diisocyanate), aromatic aliphatic diisocyanates (e.g., α,α,α',α'-tetramethylxylylene diisocyanate), isocyanurates (e.g., tris(isocyanatoalkyl)isocyanurate, triisocyanatocycloalkyl isocyanurate), and the above materials blocked with a phenol derivative, an oxime, or a caprolactam. Two or more of such materials can be used in combination.

When preparing the polyester prepolymer having an isocyanate group, the equivalent ratio of isocyanate group in the polyisocyanate to hydroxyl group in the polyester is preferably from 1 to 5, more preferably from 1.2 to 4, and most preferably from 1.5 to 3. When the equivalent ratio is too small, hot offset resistance of the toner may be poor. When the equivalent ratio is too large, low-temperature fixability of the toner may be poor.

The polyester prepolymer having an isocyanate group preferably includes polyisocyanate-origin units in an amount of from 0.5 to 40% by weight, more preferably from 1 to 30% by weight, and most preferably from 2 to 20% by weight. When the amount of polyisocyanate-origin units is too small, hot offset resistance, heat-resistant storage stability, and low-temperature fixability of the toner may be poor. When the amount of polyisocyanate-origin units is too large, low-temperature fixability of the toner may be poor.

The number of isocyanate group included in one molecule of the polyester prepolymer having an isocyanate group is preferably 1 or more, more preferably from 1.2 to 5, and most preferably from 1.5 to 4. When the number of isocyanate group is too small, the toner may have poor hot offset resistance.

The polyester prepolymer having an isocyanate group preferably has a weight average molecular weight of from $3\times10^3$ to $4\times10^4$, more preferably from $4\times10^3$ to $3\times10^4$. When the weight average molecular weight is too small, hot offset resistance of the toner may be poor. When the weight average molecular weight is too large, low-temperature fixability of the toner may be poor.

The above weight average molecular weight of the polyester prepolymer having an isocyanate group is a polystyrene-converted molecular weight measured by gel permeation chromatography (GPC) using tetrahydrofuran (THF) as a developing solvent.

The compound having an amino group may be, for example, a diamine, an amine having 3 or more valences, an amino alcohol, an amino mercaptan, an amino acid, a ketimine in which the amino group of such compounds is blocked, and an oxazoline. Two or more of such compounds can be used in combination. Among these compounds, a diamine, and a mixture of a diamine with a small amount of an amine having 3 or more valences are preferable.

Specific examples of the diamine include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diamine cyclohexane, isophorone diamine), and aliphatic diamines (e.g., ethylenediamine, tetramethylenediamine, hexamethylenediamine). Specific examples of the amine having 3 or more valences include, but are not limited to, diethylenetriamine and triethylenetetramine. Specific examples of the amino alcohol include, but are not limited to, ethanolamine and hydroxyethylaniline. Specific examples of the amino mercaptan include, but are not limited to, aminoethyl mercaptan and aminopropyl mercaptan. Specific examples of the amino acid include, but are not limited to, aminopropionic acid and aminocaproic acid.

The elongating reaction and/or cross-linking reaction between the compound having an amino group and the polyester prepolymer having an isocyanate group is preferably terminated by a reaction terminator, for the purpose of controlling the molecular weight of the resulting polymer. Specific preferred materials for the reaction terminator include, but are not limited to, monoamines (e.g., diethylamine, dibutylamine, butylamine, laurylamine), ketimines in which the amino groups of such monoamines are blocked, and oxazolines.

When preparing the urea-modified polyester, the equivalent ratio of isocyanate group in the polyester prepolymer having an isocyanate group to amino group in the compound having an amino group is preferably from 1/3 to 3, more preferably from 0.5 to 2, and most preferably from 2/3 to 1.5. When the equivalent ratio is too small, low-temperature fixability of the toner may be poor. When the equivalent ratio is too large, hot offset resistance of the toner may be poor.

The urea-modified polyester may include urethane bonds other than urea bonds. In this case, the equivalent ratio of urethane bonds to urea bonds is preferably from 0 to 9, more preferably from 0.25 to 4, and most preferably from 2/3 to 7/3. When the equivalent ratio is too large, hot offset resistance of the toner may be poor.

The below listed mixtures of a urea-modified polyester and a polyester are also preferable as the binder resin.

1) A mixture of a urea-modified polyester prepared by reacting a polycondensation product of ethylene oxide 2 mol adduct of bisphenol A and isophthalic acid with isophorone diisocyanate, and then further reacting with isophorone diamine; and a polyester being a polycondensation product of ethylene oxide 2 mol adduct of bisphenol A and isophthalic acid.
2) A mixture of a urea-modified polyester prepared by reacting a polycondensation product of ethylene oxide 2 mol adduct of bisphenol A and isophthalic acid with isophorone diisocyanate, and then further reacting with isophorone diamine; and a polyester being a polycondensation product of ethylene oxide 2 mol adduct of bisphenol A and terephthalic acid.
3) A mixture of a urea-modified polyester prepared by reacting a polycondensation product of ethylene oxide 2 mol adduct of bisphenol A, propylene oxide 2 mol adduct of bisphenol A, and terephthalic acid, with isophorone diisocyanate, and then further reacting with isophorone diamine; and a polyester being a polycondensation product of ethylene oxide 2 mol adduct of bisphenol A, propylene oxide 2 mol adduct of bisphenol A, and terephthalic acid.
4) A mixture of a urea-modified polyester prepared by reacting a polycondensation product of ethylene oxide 2 mol adduct of bisphenol A, propylene oxide 2 mol adduct of bisphenol A, and terephthalic acid, with isophorone diisocyanate, and then further reacting with isophorone diamine; and a polyester being a polycondensation product of propylene oxide 2 mol adduct of bisphenol A and terephthalic acid.
5) A mixture of a urea-modified polyester prepared by reacting a polycondensation product of ethylene oxide 2 mol adduct of bisphenol A and terephthalic acid with isophorone diisocyanate, and then further reacting with hexamethylenediamine; and a polyester being a polycondensation product of ethylene oxide 2 mol adduct of bisphenol A and terephthalic acid.
6) A mixture of a urea-modified polyester prepared by reacting a polycondensation product of ethylene oxide 2 mol adduct of bisphenol A and terephthalic acid with isophorone diisocyanate, and then further reacting with hexamethylenediamine; and a polyester being a polycondensation product of ethylene oxide 2 mol adduct of bisphenol A, propylene oxide 2 mol adduct of bisphenol A, and terephthalic acid.
7) A mixture of a urea-modified polyester prepared by reacting a polycondensation product of ethylene oxide 2 mol adduct of bisphenol A and terephthalic acid with isophorone diisocyanate, and then further reacting with ethylenediamine; and a polyester being a polycondensation product of ethylene oxide 2 mol adduct of bisphenol A and terephthalic acid.
8) A mixture of a urea-modified polyester prepared by reacting a polycondensation product of ethylene oxide 2 mol adduct of bisphenol A and isophthalic acid with diphenylmethane diisocyanate, and then further reacting with hexamethylenediamine; and a polyester being a polycondensation product of ethylene oxide 2 mol adduct of bisphenol A and isophthalic acid.
9) A mixture of a urea-modified polyester prepared by reacting a polycondensation product of ethylene oxide 2 mol adduct of bisphenol A, propylene oxide 2 mol adduct of bisphenol A, terephthalic acid, and dodecenylsuccinic anhydride, with diphenylmethane diisocyanate, and then further reacting with hexamethylenediamine; and a polyester being a polycondensation product of ethylene oxide 2 mol adduct of bisphenol A, propylene oxide 2 mol adduct of bisphenol A, and terephthalic acid.
10) A mixture of a urea-modified polyester prepared by reacting a polycondensation product of ethylene oxide 2 mol adduct of bisphenol A and isophthalic acid with toluene diisocyanate, and then further reacting with hexamethylenediamine; and a polyester being a polycondensation product of ethylene oxide 2 mol adduct of bisphenol A and isophthalic acid.

Each of the polyester and the modified polyester preferably has a weight average molecular weight of $3\times10^3$ or more, more preferably from $5\times10^3$ to $1\times10^6$, and most preferably from $7\times10^3$ to $5\times10^5$. When the weight average molecular weight is too small, hot offset resistance of the toner may be poor.

The above weight average molecular weight is a polystyrene-converted molecular weight measured by gel permeation chromatography (GPC) using tetrahydrofuran (THF) as a developing solvent.

Each of the polyester and the modified polyester preferably has a glass transition temperature of from 30 to 70° C., and more preferably from 40 to 65° C. When the glass transition temperature is too low, heat-resistant storage stability of the toner may be poor. When the glass transition temperature is too high, low-temperature fixability of the toner may be poor.

The glass transition temperature can be measured using instruments TA-60WS and DSC-60 (from Shimadzu Corporation).

The mother toner may further include a colorant, a release agent, a cleanability improver, a magnetic material, etc.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. Two or more of such colorants can be used in combination.

The content of the colorant in the mother toner is preferably from 1 to 15% by weight, and more preferably from 3 to 10% by weight. When the content is too small, coloring power of the toner may be poor. When the content is too large, the colorant cannot be finely dispersed in the mother toner, degrading coloring power and electric properties of the toner.

The colorant can be combined with a resin to be used as a master batch. Specific examples of the resin for use in the master batch include, but are not limited to, polyester, styrene or styrene derivatives polymers (e.g., polystyrene, poly-p-chlorostyrene, polyvinyl toluene), copolymers of the above styrene polymers and vinyl compounds (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, and paraffin wax. Two or more of such resins can be used in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

Specific preferred materials for the release agent include, but are not limited to, plant waxes (e.g., carnauba wax, cotton wax, sumac wax, rice wax), animal waxes (e.g., bees wax, lanoline), mineral waxes (e.g., ozokerite, ceresin), natural waxes (e.g., paraffin, microcrystalline, petroleum wax such as petrolatum), synthetic hydrocarbon waxes (e.g., Fisher-Tropsch wax, polyethylene wax), and synthetic waxes (e.g., ester, ketone, ether). Two or more of such release agents can be used in combination. Further, fatty acid amides (e.g., 12-hydroxystearic acid amide, stearic acid amide, phthalic anhydride imide, chlorinated hydrocarbon) and homopolymers or copolymers of alkyl acrylates or methacrylates (e.g., poly(n-stearyl methacrylate), poly(n-lauryl methacrylate), n-stearyl acrylate-ethyl methacrylate copolymer) are also preferable for the release agent.

The release agent preferably has a melting point of from 50 to 120° C., and more preferably from 60 to 90° C. When the melting point is too low, heat-resistant storage stability of the toner may be poor. When the melting point is too high, cold offset may occur when the toner is fixed at low temperatures.

The release agent preferably has a melt viscosity of from 5 to 1,000 cps, more preferably from 10 to 100 cps, at a temperature 20° C. higher than the melting point. When the melt viscosity is too low, releasability of the toner may be poor. When the melt viscosity is too high, hot offset resistance and low-temperature fixability of the toner may be poor.

The content of the release agent in the mother toner is preferably from 0 to 40% by weight, and more preferably from 3 to 30% by weight. When the content is too large, fluidity of the toner may be poor.

Specific preferred materials for the cleanability improver include, but are not limited to, metal salts of fatty acids (e.g., zinc stearate, calcium stearate) and resin particles prepared by soap-free emulsion polymerization (e.g., poly(methyl methacrylate) particles, polystyrene particles). Such resin particles preferably have a narrow size distribution, and a volume average particle diameter of from 0.01 to 1 μm.

Specific examples of usable magnetic materials include, but are not limited to, iron powder, magnetite, and ferrite.

A fluidity improver may be externally mixed with the mother toner so as to be present on the surface of the mother toner. Specific preferred materials for the fluidity improver include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of such materials can be used in combination. Hydrophobized silica and hydrophobized titanium oxide, which are silica and titanium oxide surface-treated with a silane coupling agent, a silylation agent, a silane coupling agent having a fluorinated alkyl group, an organic titanate coupling agent, an aluminum coupling agent, a silicone oil, or a modified silicone oil, are also preferable.

The fluidity improver preferably has an average primary particle diameter of from 5 to 50 nm, more preferably from 10 to 30 nm, and a BET specific surface area of from 20 to 500 $m^2/g$.

The content of the fluidity improver in the toner is preferably from 0.01 to 5% by weight, and more preferably from 0.01 to 2% by weight.

The toner according to this specification preferably has a weight average particle diameter of from 1 to 6 μm, and more preferably from 2 to 5 μm. When the weight average particle diameter is too small, toner particles may scatter when transferred. When the weight average particle diameter is too large, the toner may not precisely reproduce dots and degrade granularity of the resulting halftone images.

The ratio of the weight average particle diameter to the number average particle diameter is preferably from 1.05 to 1.25. When the ratio is too small, toner particles may adhere to the surfaces of carrier particles while agitated in the developing device and degrade charging power of the carrier particles, when used for a two-component developer. Also, cleanability of such toner particles may be poor. Alternatively, such toner particles may form an film on a developing roller or adhere to a toner regulating member. when used for a one-component developer. By contrast, when the ratio is too large, high-resolution high-quality images cannot be produced because such a toner has a wide size distribution as well as a wide charge distribution. Moreover, when used for a two-component developer, the average toner size in the developer may considerably vary through repeated consumption and supplement of toner particles.

When the ratio of the weight average particle diameter to the number average particle diameter is from 1.05 to 1.25, storage stability, low-temperature fixability, hot offset resistance of the toner are good. Also, such a toner can produce high-gloss images with a full-color image forming apparatus.

The weight average particle diameter and the number average particle diameter of toner can be measured by a particle size analyzer MULTISIZER III (from Beckman Coulter).

Preferably, the common logarithm of the volume resistivity of the toner according to this specification is from 10.9 to 11.4 Log(Ω·cm). When the common logarithm of the volume resistivity is too small, conductivity of the toner may be too large, causing background fouling or toner scattering in the resulting image or causing electrostatic offset. When the common logarithm of the volume resistivity is too large, the resulting image density may be too low because the toner charge is too large.

The volume resistivity of toner can be determined by pelletizing a predetermined amount of the toner, and measuring the volume resistivity of the pellet.

The toner according to this specification preferably has an average circularity of from 0.95 to 0.99. When the average circularity is too small, the toner may not develop a latent image into a uniform toner image, or transfer efficiency of the toner may be poor. When the average circularity is too large, cleanability of the toner may be poor.

The circularity of one toner particle is determined from the following formula:

$$\text{Circularity}=Cs/Cp$$

wherein Cp represents the circumferential length of a projected image of a toner particle and Cs represents the circumferential length of a circle having the same area as the projected image of the toner particle. Thus, the average particle circularity of toner is the average of the above-calculated circularity of each toner particle. The circularity can be measured by a flow-type particle shape analyzer FPIA-2100 (from Sysmex Corporation).

The method of manufacturing toner according to this specification includes: preparing a first liquid by dissolving or dispersing toner components including a calixarene having a halogen group and one or both of a binder resin and a precursor of the binder resin in an organic solvent; preparing a second liquid by emulsifying or dispersing the first liquid in an aqueous medium; removing the organic solvent from the second liquid; preparing a third liquid by washing the second liquid from which the organic solvent is removed; and adding a charge controlling agent having a halogen group to the third liquid. The calixarene having a halogen group does not decompose through the above processes and remains within the resulting mother toner. The particle diameter of the resulting toner can be varied by varying conditions (e.g., agitation condition) for preparing the second liquid.

The precursor may be, for example, a polymer having a functional group reactive with an active hydrogen group and a compound having an active hydrogen group.

Specific preferred materials for the polymer having a functional group reactive with an active hydrogen group include, but are not limited to, polyol resins, acrylic resins, polyester resins, and epoxy resins. Two or more of such materials can be used in combination. From the viewpoint of melting property and transparency, polyester resins are most preferable.

The functional group reactive with an active hydrogen group may be, for example, an isocyanate group, an epoxy group, a carboxyl group, or a chlorocarbonyl group. Two or more of such functional groups may be simultaneously included in the polymer. When the functional group is an isocyanate group, advantageously, the resulting binder resin will be an urea-modified polyester which suits for oil-less fixing. Such an urea-modified polyester is easy to control the molecular weight of high-molecular-weight components therein.

The organic solvent, in which the toner components are dissolved or dispersed, preferably has a boiling point less than 150° C. because such solvents are easy to remove through succeeding processes. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and mixtures thereof. Among these organic solvents, ester solvents are preferable, and particularly, ethyl acetate is preferable.

The amount of the organic solvent is preferably from 40 to 300 parts by weight, more preferably from 60 to 140 parts by weight, and most preferably from 80 to 120 parts by weight, based on 100 parts by weight of the toner components.

The toner components may further include a release agent, a cleanability improver, a magnetic material, etc. The toner components other than the binder resin and the precursor (e.g., a polymer having a functional group reactive with an active hydrogen group) may not necessarily be added to the first liquid at the time the first liquid is prepared and may be added to the aqueous medium, or alternatively, added to the aqueous medium at the time the first liquid is emulsified or dispersed in the aqueous medium. In a case in which the compound having an active hydrogen group is added after emulsifying or dispersing the first liquid in the aqueous medium, the resulting binder resin originated from the precursor (e.g., a polymer having a functional group reactive with an active hydrogen group) is likely to present at the surface region of the resulting mother toner, thus forming a concentration gradient of the binder resin in the mother toner.

The compound having an active hydrogen group acts as an elongating agent or a cross-linking agent for elongating or cross-linking the polymer having a functional group reactive with the active hydrogen group in the aqueous medium. The active hydrogen group may be, for example, a hydroxyl group (e.g., an alcoholic hydroxyl group, a phenolic hydroxyl group), an amino group, carboxyl group, or a mercapto group. Two or more of such active hydrogen groups may be simultaneously included in the compound. When the active hydrogen group is an amino group, the compound can advantageously react with a polyester prepolymer to form a high-molecular-weight binder resin.

Preferably, the first liquid is prepared from a dispersion in which the calixarene having a halogen group is dispersed in an organic solvent. Further, the calixarene having a halogen group therein preferably has a volume average particle diameter of from 10 to 500 nm. When the volume average particle diameter is too small, the calixarene may aggregate in the resulting toner without acting as a charge controlling agent. When the volume average particle diameter is too large, the surface profile of the resulting toner is roughened and such a toner contaminates carrier particles when used for a two-component developer, resulting in poor chargeability and poor environmental stability of the two-component developer.

The volume average particle diameter of the calixarene can be measured by a laser diffraction particle size distribution analyzer LA-920 (from Horiba, Ltd.).

Specific preferred examples of the organic solvent included in the dispersion of the calixarene having a halogen group include the above-described solvents preferable for the organic solvent in which the toner components are dissolved or dispersed. The organic solvent included in the dispersion of the calixarene having a halogen group and the organic solvent in which the toner components are dissolved or dispersed may be either the same or different.

The dispersion of the calixarene having a halogen group preferably includes a binder resin in an amount of from 5 to 25% by weight. When the amount of the binder resin is too small, the calixarene cannot be finely dispersed. When the amount of the binder resin is too large, the calixarene may aggregate when added to the first liquid.

At the time the first liquid is emulsified or dispersed in the aqueous medium, preferably, shearing force is applied from a low-speed or high-speed shearing disperser, etc.

The aqueous medium may be, for example, water, an alcohol (e.g., methanol, isopropanol, ethylene glycol), dimethylformamide, tetrahydrofuran, a cellosolve, a lower ketone (e.g., acetone, methyl ethyl ketone), or a mixture thereof. Among these aqueous media, water is most preferable.

The amount of the aqueous medium is preferably from 50 to 2,000 parts by weight, and more preferably from 100 to 1,000 parts by weight, based on 100 parts by weight of the toner components. When the amount of the aqueous medium is too small, the toner components may not be finely dispersed therein, and the resulting mother toner may not have a desired particle size. When the amount of the aqueous medium is too large, manufacturing cost may increase.

For the purpose of controlling particle diameter and particle diameter distribution of the resulting toner, the aqueous medium preferably includes both an anionic particulate resin having a volume average particle diameter of from 5 to 50 nm, more preferably from 10 to 25 nm, and an anionic surfactant. The anionic particulate resin adheres to the surfaces of liquid droplets of the first liquid dispersed in the second liquid, and fuses with each other to form a relatively hard surface thereon. Simultaneously, the anionic particulate resin adhered to the surfaces of the liquid droplets prevents the liquid droplets from uniting with each other. Advantageously, the anionic particulate resin also gives a negative charge to the resulting toner.

The volume average particle diameter of the anionic particulate resin can be measured by a laser diffraction particle size distribution analyzer LA-920 (from Horiba, Ltd.).

The anionic particulate resin can be dispersed in the aqueous medium in the presence of the anionic surfactant. The content of each of the anionic surfactant and the anionic particulate resin in the aqueous medium is preferably from 0.5 to 10% by weight.

The toner according to this specification preferably has a BET specific surface area of from 0.5 to 4 $m^2/g$, and more preferably from 0.5 to 2 $m^2/g$. When the BET specific surface area is too small, the particulate resin may densely cover the surface of the toner. Therefore, the binder resin cannot fix on a recording material, increasing the minimum fixable temperature of the toner. The particulate resin may also prevent the release agent from exuding from the toner, causing offset problem. By contrast, when the BET specific surface area is too large, the particulate resin may project or form a sparse multilayer on the surface of the toner. Therefore, the binder resin cannot fix on a recording material, increasing the minimum fixable temperature of the toner. The particulate resin may also prevent a release agent from exuding from the toner, causing offset problem.

The BET specific surface area can be measured by a micromeritics automatic surface area and porosimetry analyzer TriStar 3000 (from Shimadzu Corporation).

The particulate resin may be comprised of a resin dispersible in aqueous media. Specific examples of such resins include, but are not limited to, thermoplastic and thermosetting resins such as vinyl resin, polyurethane, epoxy resin, polyester, polyamide, polyimide, silicon-containing resin, phenol resin, melamine resin, urea resin, aniline resin, ionomer resin, and polycarbonate resin. Two or more of such resins can be used in combination. Among these resins, vinyl resin, polyurethane, epoxy resin, and polyester are preferable because they are easy to form fine spherical particles. The vinyl resin is a homopolymer or copolymer of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The particulate resin can be prepared by the following methods, for example.

1) Subjecting a vinyl monomer to a suspension polymerization, an emulsion polymerization, a seed polymerization, or a dispersion polymerization.
2) Dispersing a precursor of a polyaddition or polycondensation resin (e.g., polyester, polyurethane, epoxy resin) or a solution thereof in an aqueous medium in the presence of a disperser, and then polymerizing or curing the precursor.
3) Adding an emulsifier to a precursor of a polyaddition or polycondensation resin (e.g., polyester, polyurethane, epoxy resin) or a solution thereof, and then adding an aqueous medium thereto to cause phase-inversion emulsification.
4) Pulverizing a resin into particles using a mechanical rotary pulverizer or a jet pulverizer, classifying the particles by size, and then dispersing the desired-size particles in an aqueous medium in the presence of a disperser.
5) Spraying a resin solution to obtain resin particles, and dispersing the resin particles in an aqueous medium in the presence of a disperser.
6) Adding or dissolving a poor solvent in a resin solution, cooling the resin solution, removing the solvent from the resin solution to obtain resin particles, and then dispersing the resin particles in an aqueous medium in the presence of a disperser.
7) Dispersing a resin solution in an aqueous medium in the presence of a disperser, and removing the solvent therefrom by application of heat or reduction of pressure.
8) Adding an emulsifier to a resin solution, and then adding an aqueous medium thereto to cause phase-inversion emulsification.

In order to make the resulting particulate resin anionic, preferably, an anionic surfactant is used as the above disperser, or an anionic group (e.g., carboxyl group, sulfonic group) is introduced to the resin.

Specific examples of usable anionic surfactants include, but are not limited to, alkylbenzene sulfonates, α-olefin sulfonates, and phosphates. Two or more of such surfactants can be used in combination. Particularly, anionic surfactants having a fluoroalkyl group are preferable.

Specific examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12)

sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl (C6-C10)-N-ethyl sulfonyl glycine salts, and monoperfluoroalkyl(C6-C16) ethyl phosphates.

Specific examples of commercially available such anionic surfactants having a fluoroalkyl group include, but are not limited to, SURFLON® S-111, S-112, and S-113 (from AGC Seimi Chemical Co., Ltd.); FLUORAD™ FC-93, FC-95, FC-98, and FC-129 (from Sumitomo 3M); UNIDYNE™ DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

The aqueous medium may further include an inorganic disperser having poor water solubility. Specific examples of such inorganic dispersers include, but are not limited to, calcium phosphate, calcium carbonate, titanium oxide, colloidal silica, and hydroxyapatite. Inorganic dispersers soluble in acids and bases, such as calcium phosphate, can be removed from the resulting toner by dissolving with an acid (e.g., hydrochloric acid) and then washing with water, or decomposing with an enzyme.

The aqueous medium may further include a polymeric protection colloid.

Specific examples of usable polymeric protection colloids include, but are not limited to, homopolymers and copolymers obtained from the following monomers: monomers having a carboxyl group (e.g., acrylic acid, methacrylic acid, α-cyanoacrylic acid, α-cyanomethacrylic acid, itaconic acid, crotonic acid, fumaric acid, maleic acid, maleic anhydride) and derivatives thereof; acrylate and methacrylate monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide); vinyl alkyl ether monomers (e.g., vinyl methyl ether, vinyl ethyl ether, vinyl propyl ether); vinyl carboxylate monomers (e.g., vinyl acetate, vinyl propionate, vinyl butyrate); amide monomers (e.g., acrylamide, methacrylamide, diacetone acrylamide) and methylol compounds thereof; monomers having a carbonyl chloride group (e.g., acrylic acid chloride, methacrylic acid chloride); and/or monomers containing nitrogen or a nitrogen-containing heterocyclic ring (e.g., vinyl pyridine, vinyl pyrrolidone, vinyl imidazole, ethylene imine). Additionally, polyoxyethylene-based resins (e.g., polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose) are also preferable.

Preferably, the binder resin is prepared after preparing the second liquid, by reacting the compound having an active hydrogen group with the polymer having a functional group reactive with the active hydrogen group. In this case, the resulting toner has better mechanical strength, and therefore the particulate resin and fluidity improver may not be buried in the toner. When the compound having an active hydrogen group is cationic, the toner may advantageously attract the particulate resin electrostatically. Additionally, melt properties of the toner can also be adjusted to widen the fixable temperature range.

The reaction time between the compound having an active hydrogen group and the polymer having a functional group reactive with the active hydrogen group for forming the binder resin is preferably from 10 minutes to 40 hours, and more preferably from 2 to 24 hours.

The organic solvent is removed from the second liquid. Specifically, the organic solvent can be removed from the second liquid by, for example, gradually heating the second liquid to evaporate the organic solvent from liquid droplets of the first liquid.

The third liquid is prepared by washing the second liquid. Specifically, the second liquid can be washed by, for example, filtering the second liquid and re-dispersing the resulting cake in an aqueous solvent. Specific preferred examples of the aqueous solvent include the above-described solvents preferable for the aqueous medium. The aqueous solvent and the aqueous medium may be either the same or different.

Preferably, the charge controlling agent having a halogen group is diluted with an aqueous solvent before added to the third liquid. Thus, preferably, a dilution of the charge controlling agent having a halogen group is added to the third liquid. Specific preferred examples of the aqueous solvent include the above-described solvents preferable for the aqueous medium. The aqueous solvent and the aqueous medium may be either the same or different.

The third liquid to which the charge controlling agent having a halogen group is added is then subjected to filtration and drying to prepare the toner. The third liquid may be optionally subjected to classification using a cyclone, a decanter, or a centrifugal separator, before the filtration or after the drying.

Preferably, the third liquid to which the charge controlling agent having a halogen group is added is heated, for the purpose of smoothing the surface of the resulting toner.

Preferably, the third liquid is heated to a temperature between 10° C. lower and 10° C. higher than a glass transition temperature of the binder resin. When the temperature is too low, the surface of the resulting toner may not be satisfactorily smoothened. When the temperature is too high, each of toner particles may aggregate with each other.

Alternatively, the third liquid is heated before the charge controlling agent having a halogen group is added thereto.

The developer according to this specification includes the above-described toner, and optionally includes a carrier. When the developer includes the carrier, the weight ratio of the toner to the carrier is from 1 to 10%.

Specific preferred materials for the carrier include, but are not limited to, iron powder, ferrite powder, magnetite powder, and magnetic resin carriers.

The above carriers may be covered with a resin. Specific examples of usable resins for covering the carriers include, but are not limited to, amino resins (e.g., urea-formamide resin, melamine resin, benzoguanamine resin, urea resin, polyamide, epoxy resin), acrylic resins, polymethyl methacrylate, polyacrylonitrile, polyvinyl acetate, polyvinyl alcohol, polyvinyl butyral, polystyrene, styrene-acrylic resin, halogenated olefin resins (e.g., polyvinyl chloride), polyethylene, polyvinyl fluoride, polyvinylidene fluoride, polytrifluoroethylene, polyhexafluoropropylene, vinylidene fluoride-acrylic copolymer, vinylidene fluoride-vinyl fluoride copolymer, fluoroterpolymers (e.g., a terpolymer of tetrafluoroethylene, vinylidene fluoride, and non-fluorinated monomer terpolymer), polyester resins (e.g., polyethylene terephthalate, polybutylene terephthalate), polycarbonate, and silicone resins.

The above resins optionally include a conductive powder, such as a metal powder, carbon black, titanium oxide, tin oxide, and zinc oxide.

Such conductive powders preferably have an average diameter of 1 μm or less. When the average particle diameter is too large, it is difficult to control electric resistivity of the carrier.

The carrier preferably has a weight average particle diameter of from 15 to 50 μm. When the weight average particle diameter is too small, carrier particles may deposit on the resultant image. When weight average particle diameter is too large, background fouling may occur in the resultant image when the toner concentration in the developer is relatively large, or granularity of the resultant high-light image may deteriorate when the dot size of electrostatic latent images is relatively small.

The weight average particle diameter of carrier can be measured by a Microtrac particle size analyzer HRA9320-X100 (from Microtrac).

Next, the image forming method according to this specification is described with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 schematically illustrates a tandem image forming apparatus 100 for practicing the image forming method according to this specification. The tandem image forming apparatus 100 includes a main body 150, a paper feed table 200, a scanner 300, and an automatic document feeder (ADF) 400.

An intermediate transfer belt 50 is provided in the center of the main body 150. The intermediate transfer belt 50 is stretched taut with rollers 14, 15, and 16, and is rotatable clockwise in FIG. 1. Image forming units 18Bk, 18C, 18M, and 18Y are arranged in tandem in this order along a part of the conveyance path of the intermediate transfer belt stretched taut between the rollers 14 and 15.

An irradiator 21 is provided above the image forming units 18Bk, 18C, 18M, and 18Y. The irradiator 21 provides four optical paths for emitting light onto respective photoreceptors 10Bk, 10C, 10M, and 10Y based on image signals. The irradiator 21 may be, for example, a laser light source, a light deflector (e.g., a polygon mirror), or a laser scanning optical system comprised of a scanning image optical system and mirrors.]

A secondary transfer device 22 is provided on the opposite side of the intermediate transfer belt 50 from the image forming units 18Bk, 18C, 18M, and 18Y. The secondary transfer device 22 comprises a belt 24 stretched taut with two rollers 23. The belt 24 is pressed against the roller 16 with the intermediate transfer belt 50 therebetween so that a full-color toner image is transferred from the intermediate transfer belt 50 onto a sheet (e.g., paper).

A fixing device 25 is provided on the left side of the secondary transfer device 22. The sheet having the full-color image thereon is conveyed to the fixing device 25, and the fixing device 25 fixes the full-color toner image on the sheet. The fixing device 25 includes a heating belt 26 supported with two rollers and a pressing roller 27 pressed against the heating belt 26. A sheet reversing device 28 is provided below the secondary transfer device 22 and the fixing device 25. The sheet reversing device 28 reverses a sheet when forming images on both sides of the sheet.

To make a copy, first, a document is set on a document table 130 of the automatic document feeder 400. Alternatively, a document is set on a contact glass 32 of the scanner 300 while lifting up the automatic document feeder 400, and then the automatic document feeder 400 holds down.

Upon pressing of a switch, not shown, in a case in which a document is set on the contact glass 32, the scanner 300 immediately starts driving so that a first runner 33 and a second runner 34 start moving. In a case in which a document is set on the document table 130, the scanner 300 starts driving after the document is fed onto the contact glass 32. The first runner 33 directs a light beam onto the document, and reflects a reflected light beam from the document toward the second runner 34. A mirror in the second runner 34 further reflects the reflected light beam toward an imaging lens 35. The light beam passed through the imaging lens 35 is then received by a reading sensor 36 and image information of black, cyan, magenta, and yellow is read. An image processing part, not shown, converts the image information into image signals, and the image signals are transmitted to the irradiator 21.

On the other hand, upon pressing of the switch, at least one of the rollers 14, 15, and 16 is driven to rotate by a driving motor, not shown, and the other rollers are driven to rotate by the driving roller to rotatably convey the intermediate transfer belt 50. Simultaneously, the photoreceptors 10Bk, 10C, 10M, and 10Y in the respective image forming units 18Bk, 18C, 18M, and 18Y start rotating so that monochromatic toner images of black, cyan, magenta, and yellow are formed on the respective photoreceptors 10Bk, 10C, 10M, and 10Y. The black, cyan, magenta, and yellow toner images formed on the respective photoreceptors 10Bk, 10C, 10M, and 10Y are then sequentially transferred onto the intermediate transfer belt 50 and superimposed on one another. Thus, a composite full-color toner image is formed.

On the other hand, upon pressing of the switch, one of paper feed rollers 142 starts rotating in the paper feed table 200 so that a sheet is fed from one of paper feed cassettes 144 in a paper bank 143. The sheet is separated by one of separation rollers 145 and fed to a paper feed path 146. Feed rollers 147 feed the sheet to a paper feed path 148 in the main body 150. The sheet is stopped by a registration roller 49. Alternatively, a sheet is fed from a manual feed tray 51 by rotating a feed roller 52, separated by a separation roller 58, fed to a manual paper feed path 53, and stopped by the registration roller 49.

The registration roller 49 feeds the sheet to between the intermediate transfer belt 50 and the secondary transfer device 22 in synchronization with an entry of the composite full-color toner image thereto. Preferably, the toner image is transferred from the intermediate transfer belt 50 onto the sheet at a linear speed of from 0.1 to 1 m/sec within a transfer time of from 0.5 to 60 msec.

The sheet having the full-color toner image thereon is conveyed from the secondary transfer device 22 to the fixing device 25. The fixing device 25 fixes the full-color toner image on the sheet by application of heat and pressure. The sheet on which the full-color toner image is fixed is switched by a switch pick 55 so as to be discharged onto a discharge tray 57 by rotating a discharge roller 56. Alternatively, the sheet on which the full-color toner image is fixed is switched by the switch pick 55 so as to be fed to the sheet reversing device 28. The revered sheet is fed to the paper feed path 148 and stopped by the registration roller 49. The sheet having images on both sides thereof is then discharged onto the discharge tray 57 by rotating the discharge roller 56. The registration roller 49 is generally grounded, however, a bias may be applied thereto if removal of paper powder is needed.

Figure 2:
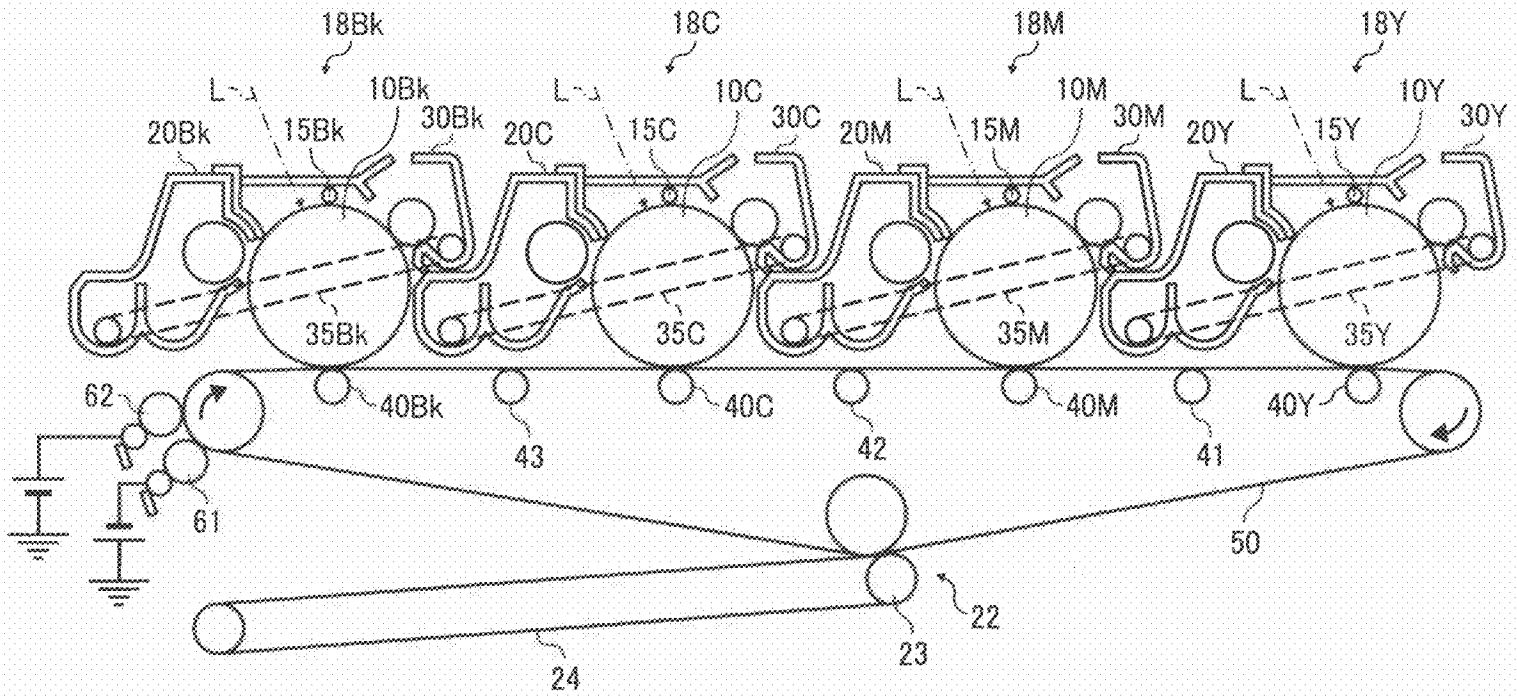
FIG. 2 schematically illustrates the image forming units included in the image forming apparatus illustrated in FIG. 1.

FIG. 2 schematically illustrates the image forming units 18Bk, 18C, 18M, and 18Y. The image forming units 18Bk, 18C, 18M, and 18Y respectively include the respective photoreceptors 10Bk, 10C, 10M, and 10Y. The photoreceptors may be an organic photoconductor, for example. Around the photoreceptors 10Bk, 10C, 10M, and 10Y, respective chargers 15Bk, 15C, 15M, and 15Y, respective developing devices 20Bk, 20C, 20M, and 20Y each containing the toner according to this specification, respective primary transfer devices 40Bk, 40C, 40M, and 40Y, and respective cleaning devices 30Bk, 30C, 30M, and 30Y are provided. Neutralization devices may be also provided, if needed. In FIG. 2, L represents light beams emitted from the irradiator 21 onto the photoreceptors 10Bk, 10C, 10M, and 10Y. Conductive rollers 41, 42, and 43 are further provided between the primary transfer devices 40Bk, 40C, 40M, and 40Y. The intermediate transfer belt 50 is provided between the photoreceptors 10Bk, 10C, 10M, and 10Y and the primary transfer devices 40Bk, 40C, 40M, and 40Y so that black, cyan, magenta, and yellow toner images are sequentially transferred from the respective photoreceptors 10Bk, 10C, 10M, and 10Y onto the intermediate transfer belt 50 and superimposed on one another, thus forming a full-color toner image.

The full-color toner image on the intermediate transfer belt 50 may contain either a half-tone image portion or a solid image portion. Thus, the amount and charge amount of toner may be different by location within the full-color toner image on the intermediate transfer belt 50. Additionally, it is likely that electric discharge occurs in gaps adjacent to and downstream from the respective primary transfer devices 40Bk, 40C, 40M, and 40Y relative to the direction of conveyance of the intermediate transfer belt 50, thereby varying charge amount within the full-color toner image on the intermediate transfer belt 50 by location. Such a variation in charge amount within the full-color toner image decreases transfer efficiency in the secondary transfer device 22. Therefore, it is preferable that a pre-transfer charger is provided downstream from the yellow primary transfer device 40Y and upstream from the secondary transfer device 22 relative to the direction of conveyance of the intermediate transfer belt 50. The pre-transfer charger uniformly charges the full-color toner image to the same polarity before the full-color toner image is transferred from the intermediate transfer belt 50 onto the sheet, to remove the variation in charge amount within the full-color toner image and prevent the decrease of transfer efficiency in the secondary transfer device 22. Thus, the full-color toner image is reliably transferred from the intermediate transfer belt 50 onto the sheet.

The amount of charge given from the pre-transfer charger to the full-color toner image varies depending on the conveyance speed of the intermediate transfer belt 50. As the conveyance speed of the intermediate transfer belt 50 becomes faster, the transit time of the full-color toner image in the pre-transfer charger charging area becomes longer, and the charge amount of the full-color toner image becomes larger. In a case in which the conveyance speed of the intermediate transfer belt 50 varies while the full-color toner image transits the pre-transfer charger charging area, it is preferable that the pre-transfer charger is controlled to charge the full-color toner image to a constant charge level regardless of variation in the conveyance speed of the intermediate transfer belt 50.

The full-color toner image on the intermediate transfer belt 50 has a negative polarity before transferred onto the sheet in the secondary transfer device 22. Therefore, the full-color toner image can be transferred from the intermediate transfer belt 50 onto the sheet upon application of a positive bias voltage to the roller 23. Generally, the nip pressure between the intermediate transfer belt 50 and the roller 23 has effect on transfer efficiency. Residual toner particles remaining on the intermediate transfer belt 50 after the full-color toner image is transferred therefrom are charged to a positive polarity at the instant that the sheet separates from the intermediate transfer belt 50. On the other hand, toner particles scattered on non-image areas by paper jam, etc., remain unaffected by the secondary transfer and keep the negative polarity.

The residual toner particles remaining on the intermediate transfer belt 50 are removed by a conductive fur brush 61 to which a positive voltage is applied and another conductive fur brush to which a negative voltage is applied. In a case in which a part of the residual toner particles cannot be removed by the conductive fur brush 62, such toner particles are charged to a negative polarity. The toner particles thus negatively charged are attracted to the intermediate transfer belt 50 in the subsequent primary transfer, thus preventing migration of the toner particles onto the photoreceptors 10Bk, 10C, 10M, and 10Y.

The developing devices 20Bk, 20C, 20M, and 20Y and the cleaning devices 30Bk, 30C, 30M, and 30Y are connected by respective toner transport tubes 35Bk, 35C, 35M, and 35Y. Each of the toner transport tubes 35Bk, 35C, 35M, and 35 incorporates a screw, not shown, for transporting toner particles collected in the respective cleaning devices 30Bk, 30C, 30M, and 30Y to the respective developing devices 20Bk, 20C, 20M, and 20Y.

Since the photoreceptors 10Bk, 10C, 10M, and 10Y do not directly contact paper (i.e., a recording material), toner particles collected in the cleaning devices 30Bk, 30C, 30M, and 30Y do not contain paper powders and the intermediate transfer belt 50 is not contaminated with paper powders at the secondary transfer. Thus, the resulting image does not deteriorate. Also, provision of the independent image forming units 18Bk, 18C, 18M, and 18Y prevents mixing of the collected toner particles with different colors.

The intermediate transfer belt 50 comprises a single resin layer and optional elastic layer and/or surface layer.

Specific preferred resins for the resin layer include, but are not limited to, polycarbonate; fluorocarbon resins (e.g., ETFE, PVDF); styrene-based resins, i.e., homopolymer and copolymer of styrene or styrene derivatives (e.g., polystyrene, poly(α-chlorostyrene), poly(α-methylstyrene), styrene-butadiene copolymer, styrene-vinyl chloride copolymer, styrene-vinyl acetate copolymer, styrene-maleic acid copolymer, styrene-acrylate copolymers (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (such as styrene-methyl methacrylate copolymer, styrene-ethyl methacrylate copolymer, and styrene-phenyl methacrylate copolymer), styrene-methyl α-chloroacrylate, and styrene-acrylonitrile-acrylate copolymer; acrylic resins (e.g., methyl methacrylate resin, butyl methacrylate resin, ethyl acrylate resin, butyl acrylate resin); modified acrylic resins (e.g., silicone-modified acrylic resin, vinyl chloride-modified acrylic resin, acrylic urethane resin); and other resins such as vinyl chloride resin, vinyl chloride-vinyl acetate copolymer, rosin-modified maleic acid resin, phenol resin, epoxy resin, polyester, polyester polyurethane, polyethylene, polypropylene, polybutadiene, polyvinylidene chloride, ionomer resin, polyurethane, silicone resins, ketone resins, ethylene-ethyl acrylate copolymer, xylene resin, polyvinyl butyral resin, polyamide, and modified polyphenylene oxide. Two or more of these resins can be used in combination.

Specific preferred materials for the elastic layer include, but are not limited to, elastic rubbers (e.g., butyl rubber, fluorocarbon rubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, polysulfide rubber, polynorbornene rubber, hydrogenated nitrile rubber); and thermoplastic elastomers (e.g., polystyrene-based elastomer, polyolefin-based elastomer, polyvinyl chloride-based elastomer, polyurethane-based elastomer, polyamide-based elastomer, polyurea-based elastomer, polyester-based elastomer, fluorocarbon-based elastomer). Two or more of these materials can be used in combination.

Preferred materials for the surface layer include those which can improve the secondary transfer efficiency by reducing adhesive force of toner particles to the intermediate transfer belt 50. Such materials can be prepared by dispersing a material which improves lubricity by reducing surface energy in a resin. Specific preferred examples for the resin include, but are not limited to, polyurethane, polyester, and epoxy resin. Two or more of these resins can be used in combination. Alternatively, the surface layer may be a fluorine-rich surface layer comprised of a fluorocarbon resin that reduces surface energy.

Each of the resin and elastic layers may include a conductive agent for controlling resistivity. Specific preferred materials for the conductive agent include, but are not limited to, carbon black, graphite, metal powders (e.g., aluminum, nickel), and conductive metal oxides (e.g., tin oxide, titanium oxide, antimony oxide, indium oxide, potassium titanate, antimony-tin complex oxide (ATO), indium-tin complex oxide (ITO)). Two or more of these materials can be used in combination. The conductive metal oxides can be covered with insulative particles of barium sulfate, magnesium silicate, and calcium carbonate.

Figure 3:
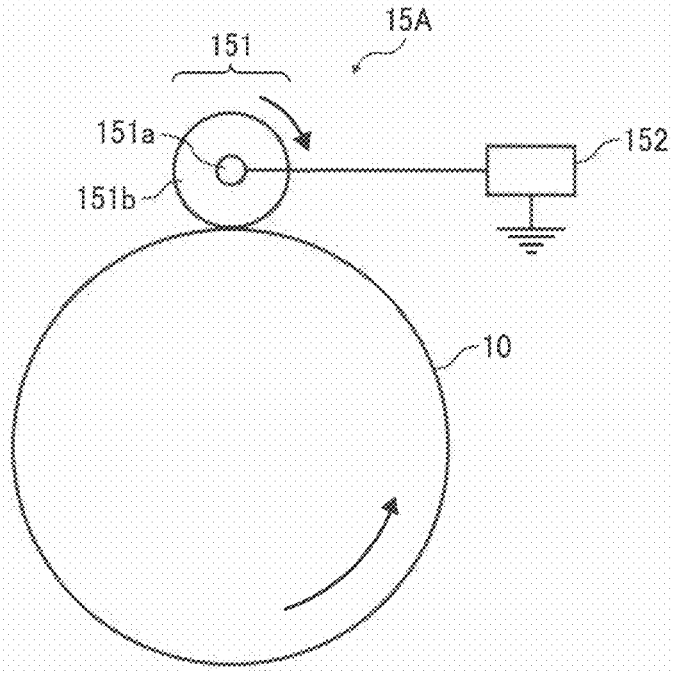
FIG. 3 schematically illustrates one exemplary embodiment of the charger illustrated in FIG. 2, a roller-type charger.

FIG. 3 schematically illustrates one exemplary embodiment of the chargers 15Bk, 15C, 15M, and 15Y (hereinafter collectively the "charger 15"), a roller-type charger 15A, which is one of contact chargers. In this embodiment, the photoreceptor 10 is driven to rotate counterclockwise in FIG. 3 at a predetermined speed. A charging roller 151 is contacted against the photoreceptor 10 with a predetermined pressure by a pressing member, not shown, and rotates along with rotation of the photoreceptor 10. The charging roller 151 is comprised of a core metal 151*a* and a conductive rubber layer 151*b* concentrically provided on the outer circumferential surface of the core metal 151*a*. Both ends of the core metal 151*a* are rotatably supported by bearing members, not shown. A power source 152 is electrically connected to the core metal 151*a* to apply a predetermined bias to the charging roller 151. Thus, a circumferential surface of the photoreceptor 10 is uniformly charged to a predetermined potential with a predetermined polarity.

Figure 4:
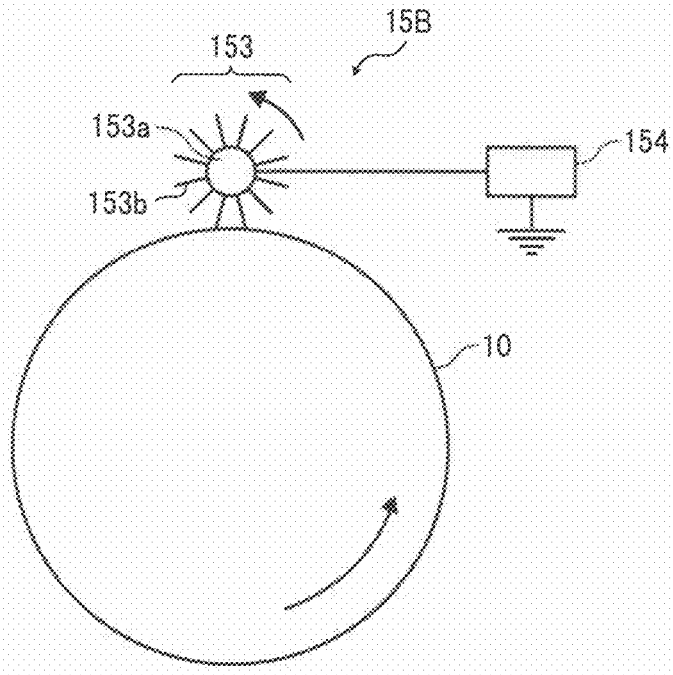
FIG. 4 schematically illustrates another exemplary embodiment of the charger illustrated in FIG. 2, a fur brush-type charger.

FIG. 4 schematically illustrates another exemplary embodiment of the charger 15, a fur brush-type charger 15B. In this embodiment, the photoreceptor 10 is driven to rotate counterclockwise in FIG. 4 at a predetermined speed. A fur brush roller 153 is contacted against the photoreceptor 10 with a predetermined pressure, and is driven to rotate at a predetermined speed in the opposite direction to the photoreceptor 10. The fur brush roller 153 is comprised of a core metal 153*a* and a fur brush 153*b* concentrically provided on the outer circumferential surface of the core metal 153*a*. Both ends of the core metal 153*a* are rotatably supported by bearing members, not shown. A power source 154 is electrically connected to the core metal 153*a* to apply a predetermined bias to the fur brush roller 153. Thus, a circumferential surface of the photoreceptor 10 is uniformly charged to a predetermined potential with a predetermined polarity.

The fur brush 153*b* can be prepared by winding or adhering a fur conductively treated with carbon black, copper sulfide, a metal, or a metal oxide, to the core metal 153*a* conductively treated with a metal, etc. Specific preferred commercially available materials for the fur include, but are not limited to, REC-B, REC-C, REC-M1, and REC-M10 (all from Unitika Ltd.); SA-7 (from Toray Industries, Inc.); Thunderon® (from Nihon Sanmo Dyeing Co., Ltd.); Belltron® (from KB Seiren, Ltd.); and CLACARBO (from Kuraray Co., Ltd.). The fur preferably has a line density of from 3 to 10 deniers and a length of from 1 to 10 mm. The fur brush 153*b* preferably includes 10 to 100 filaments/bundle, and has a density of 80 to 600 filaments/$mm^2$.

Figure 5:
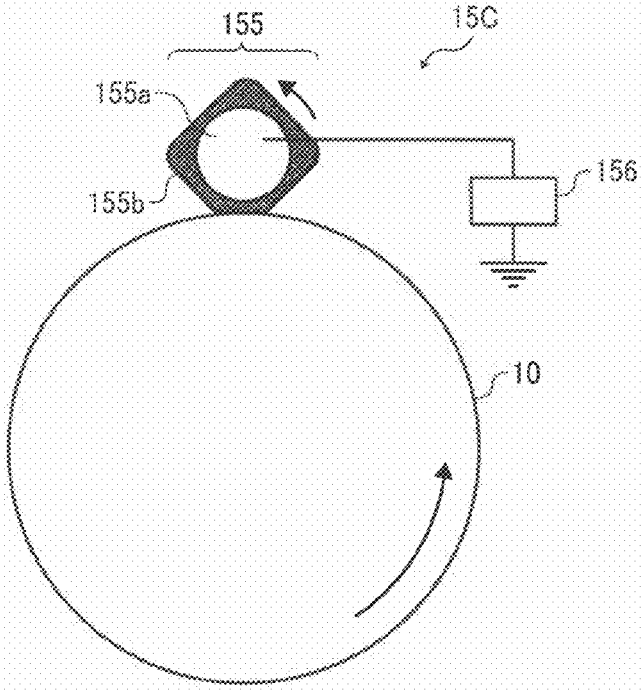
FIG. 5 schematically illustrates yet another exemplary embodiment of the charger illustrated in FIG. 2, a magnetic brush-type charger.

FIG. 5 schematically illustrates another exemplary embodiment of the charger 15, a magnetic brush-type charger 15C. In this embodiment, the photoreceptor 10 is driven to rotate counterclockwise in FIG. 5 at a predetermined speed. A magnetic brush roller 155 is contacted against the photoreceptor 10 with a predetermined pressure, and is driven to rotate at a predetermined speed in the opposite direction to the photoreceptor 10. The magnet brush roller 155 is comprised of a non-magnetic conductive sleeve 155*a* incorporating a magnet roll, not shown, and a magnetic brush 155*b* concentrically provided on the outer circumferential surface of the conductive sleeve 155*a*. Both ends of the conductive sleeve 155*a* are rotatably supported by bearing members, not shown. A power source 156 is electrically connected to the conductive sleeve 155*a* to apply a predetermined bias to the magnetic brush roller 155. Thus, a circumferential surface of the photoreceptor 10 is uniformly charged to a predetermined potential with a predetermined polarity.

The magnetic brush 155*b* may be comprised of magnetic particles such as Zn—Cu ferrite, for example.

Figure 6:
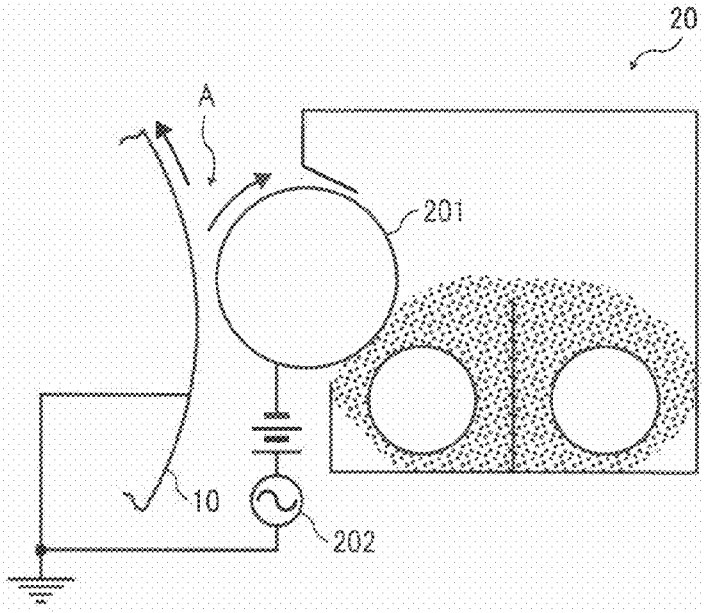
FIG. 6 schematically illustrates one exemplary embodiment of the developing devices illustrated in FIG. 2.

FIG. 6 schematically illustrates one exemplary embodiment of the developing devices 20Bk, 20C, 20M, and 20Y (hereinafter collectively the "developing device 20"). In the developing device 20, a vibratory bias voltage in which an alternating current voltage is overlapped with a direct current voltage is applied from a power source 202 to a developing sleeve 201. Since the electrical potentials of both non-image and image areas on the photoreceptor 10 are in between the maximum and minimum vibratory bias voltages, an alternating electric field generates within a developing area A. As a result, toner and carrier particles frenziedly vibrate in the developing area A, and toner particles released from the electrostatic binding force with carrier particles or the developing sleeve 201 fly and adhere to an electrostatic latent image on the photoreceptor 10.

The difference between the maximum and minimum vibratory bias voltages is preferably from 0.5 to 5 kV and the frequency of the vibratory bias voltage is preferably from 1 to 10 kHz. The wave profile of the vibratory bias voltage may be a rectangular wave, sine wave, or a triangular wave, for example. Preferably, the direct current voltage component of the vibratory bias voltage, which is in between the electrical potentials of non-image and image areas, is more close to the electrical potential of the non-image area than that of the image area. In such a case, toner particles are prevented from adhering to non-image areas on the photoreceptor 10.

In a case in which the wave profile of the vibratory bias voltage is a rectangular wave, the duty rate is preferably 50% or less. The duty rate is a rate of time period during which toner particles migrate toward the photoreceptor within one vibration cycle of the vibratory bias voltage. Thus, the difference between the maximum duty rate and the time average of the vibratory bias voltage, which is equivalent to the inverse of the frequency, becomes larger. Accordingly, toner particles move more actively and more precisely reproduce the electric potential distribution of electrostatic latent images, resulting in improvement of granularity or resolution of images.

Figure 7:
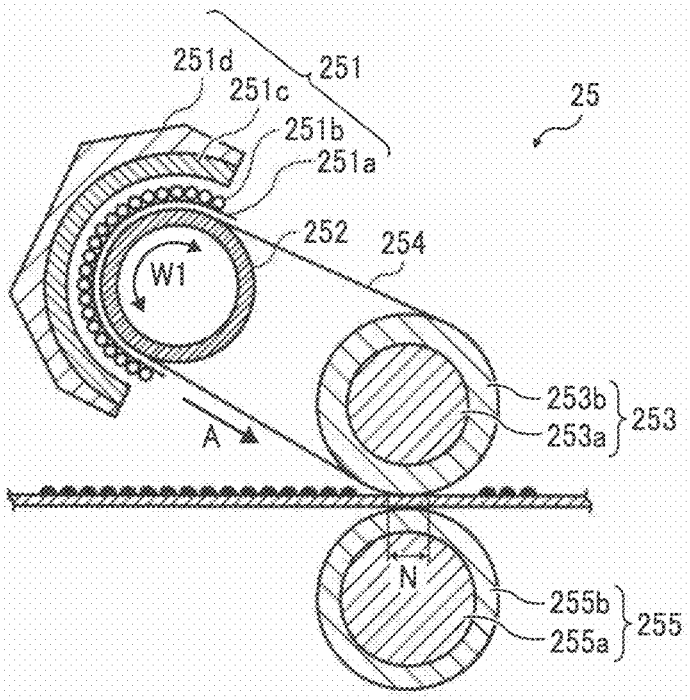
FIG. 7 schematically illustrates one exemplary embodiment of the fixing device illustrated in FIG. 2.

FIG. 7 schematically illustrates one exemplary embodiment of the fixing device 25. The fixing device 25 illustrated in FIG. 7 includes an induction heater 251, a heating roller 252 heated by electromagnetic induction of the induction heater 251, a fixing roller 253 provided facing the heating roller 252, a fixing belt 254 stretched taut over the heating roller 252 and the fixing roller 253 and heated by the heating roller 252, and a pressing roller 255 pressed against the fixing roller 253 with the fixing belt 254 therebetween. The fixing belt 254 is conveyed in the direction indicated by arrow A in FIG. 7 along with rotation of the heating roller 252 or the fixing roller 253. The pressing roller 255 rotates in the same direction as the conveyance of the fixing belt 254 while facing.

The heating roller 252 is a cylindrical member comprised of a magnetic metal, preferably having an outer diameter of from 20 to 40 mm and a wall thickness of from 0.3 to 1.0 mm. Such a member has a small heat capacity, and therefore the heating rate thereof can be improved. Specific preferred examples of the magnetic material include, but are not limited to, iron, cobalt, nickel, and alloys thereof.

The fixing roller 253 is comprised of a core metal 253*a* and an elastic layer 253*b* covering the core metal 253*a*. The core metal 253*b* may be comprised of a metal such as stainless steel, for example. The elastic layer 253*b* may be comprised of a solid or foamed heat-resistant silicone rubber, for example, and has a thickness of from 4 to 6 mm. The fixing roller 253 has an outer diameter of from 20 to 40 mm, which is greater than the outer diameter of the heating roller 252, to form a region of contact between the pressing roller 255 with a predetermined width.

The fixing belt 254 is heated by the heating roller 252, heated by electromagnetic induction of the induction heater 251, within a contact area W1. Each part of the inner surface of the fixing belt 254 is continuously heated along with rotation of the heating roller 252 or the fixing roller 253, resulting in heating of the whole inner surface of the fixing belt 254.

Figure 8:
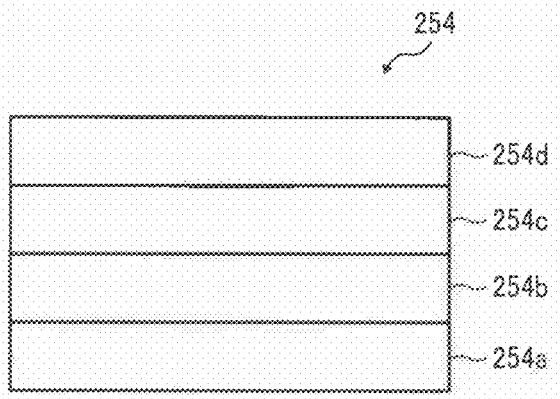
FIG. 8 schematically illustrates a cross section of the fixing belt illustrated in FIG. 7.

FIG. 8 schematically illustrates a cross section of the fixing belt 254. The fixing belt 254 has a layer structure including, from an innermost side thereof, a substrate 254*a*, a heat generating layer 254*b*, and elastic layer 254*c*, and a release layer 254*d*. The substrate 254*a* may be comprised of, for example, a heat-resistance resin such as a fluorocarbon resin, polyimide, polyamide, polyamide-imide, PEEK, PES, and PPS. The heat generating layer 254*b* may be comprised of, for example, a conductive material such as Ni, Ag, and SUS. The elastic layer 254*c* may be comprised of any material which can reliably fix full-color toner images on a sheet. The release layer 254*d* may be comprised of, for example, a fluorocarbon resin. The substrate 254*a* is not necessarily provided. In such a case, the heat generating layer 254*b* functions as the substrate.

The release layer 254*d* preferably has a thickness of from 10 to 300 μm so that a full-color toner image is completely covered and heat-melted with the fixing belt 254 when fixed on a sheet. When the thickness of the release layer 254*d* is too small, abrasion resistance may be poor. When the thickness of the release layer 254*d* is too large, heat capacity of the fixing belt is so increased that the heating rate thereof may decrease. Additionally, the surface temperature of the fixing belt 254 is unlikely to decrease, therefore toner particles may disadvantageously adhere to the fixing belt without aggregating.

The pressing roller 255 is comprised of a core metal 255*a* and an elastic layer 255*b* covering the core metal 255*a*. The core metal 255*b* may be comprised of, for example, a highly conductive metal such as copper and aluminum, or SUS. The elastic layer 255*b* may be comprised of an elastic material having high heat resistance and releasability. The pressing roller 255 has an outer diameter of from 20 to 40 mm, which is identical to that of the fixing roller 253, and a wall thickness of from 0.5 to 2.0 mm, which is thinner than that of the fixing roller 253.

The pressing roller 255 is pressed against the fixing roller 253 with the fixing belt 254 therebetween, thus forming a fixing nip N. Preferably, the hardness of the pressing roller 255 is greater than that of the fixing roller 253. In such a case, the pressing roller 255 bites into the fixing roller 253 and a sheet follows the circumferential surface profile of the pressing roller 255. As a result, the sheet easily separates from a surface of the fixing belt 254.

The induction heater 251 is comprised of a hemicylindrical coil guide plate 251*a* and an exiting coil 251*b*. The coil guide plate 251*a* is provided proximally to an outer circumferential surface of the heating roller 252. The exiting coil 251*b* is formed by winding one linear member around the coil guide plate 251*a* alternately in the axial direction of the heating roller 252. The exciting coil 251*b* is connected to a driving source, not shown, equipped with a frequency-variable oscillation circuit. A hemicylindrical exiting coil core 251*c* supported by a support member 251*d* is provided proximally to the exciting coil 251*b*. The exciting coil core 251*c* may be comprised of, for example, a ferromagnetic substance such as ferrite.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester

A reaction vessel equipped with a condenser, a stirrer, and a nitrogen inlet pipe is charged with 67 parts of ethylene oxide 2 mol adduct of bisphenol A, 84 parts of propylene oxide 3 mol adduct of bisphenol A, 274 parts of terephthalic acid, and 2 parts of dibutyl tin oxide. The mixture is subjected to reaction for 8 hours at 230° C. under normal pressures, and subsequently for 5 hours under reduced pressures of from 10 to 15 mmHg. Thus, a polyester 1 is prepared. The polyester 1 has a number average molecular weight of 2,100, a weight average molecular weight of 5,600, and a glass transition temperature of 55° C.

Preparation of Master Batch

First, 1,000 parts of water, 540 parts of a carbon black having a DBP oil absorption of 42 ml/100 g and a pH of 9.5 (PRINTEX 35 from Degussa), and 1,200 parts of the polyester 1 are mixed using a HENSCHEL MIXER (from Mitsui Mining and Smelting Co., Ltd.). The resulting mixture is kneaded for 30 minutes at 150° C. using a double roll, the kneaded mixture is then roller and cooled, and the rolled mixture is then pulverized into particles using a pulverizer (from Hosokawa Micron Corporation). Thus, a master batch is prepared.

Preparation of Polyester Prepolymer

A reaction vessel equipped with a condenser, a stirrer, and a nitrogen inlet pipe is charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyl tin oxide. The mixture is subjected to reaction for 8 hours at 230° C. under normal pressures, and subsequently for 5 hours under reduced pressures of from 10 to 15 mmHg. Thus, a polyester having a hydroxyl group is prepared. The polyester having a hydroxyl group has a number average molecular weight of 2,100, a weight average molecular weight of 9,600, a glass transition temperature of 55° C., an acid value of 0.5 mgKOH/g, and a hydroxyl value of 49 mgKOH/g.

Next, another reaction vessel equipped with a condenser, a stirrer, and a nitrogen inlet pipe is charged with 411 parts of the polyester having a hydroxyl group, 89 parts of isophorone diisocyanate, and 500 parts of ethyl acetate. The mixture is subjected to reaction for 5 hours at 100° C. Thus, a polyester prepolymer is prepared. The polyester prepolymer includes free-isocyanate in an amount of 1.6% by weight. The polyester prepolymer contains 50% by weight of solid components, which is measured after being left for 45 minutes at 150° C.

Preparation of Particulate Resin Dispersion

A reaction vessel equipped with a stirrer and a thermometer is charged with 683 parts of water, 16 parts of a sodium salt of a sulfate of ethylene oxide adduct of methacrylic acid (ELEMINOL RS-30 from Sanyo Chemical Industries, Ltd.), 83 parts of styrene, 83 parts of methacrylic acid, 110 parts of butyl acrylate, and 1 part of ammonium persulfate. The mixture is agitated for 14 minutes at 400 rpm, thus preparing a whitish emulsion. The emulsion is then heated to 75° C. and subjected to reaction for 5 hours. Thereafter, 30 parts of a 1% aqueous solution of ammonium persulfate are added thereto, and the resulting mixture is aged for 5 hours at 75° C. Thus, a particulate resin dispersion is prepared. The particulate resin in the dispersion has a volume average particle diameter of 42 nm.

Preparation of Aqueous Medium

An aqueous medium is prepared by mixing and agitating 660 parts of water, 1.25 parts of the particulate resin dispersion, 25 parts of a 48.5% aqueous solution of dodecyl diphenyl ether sodium disulfonate (MON-7 from Sanyo Chemical Industries, Ltd.), and 60 parts of ethyl acetate. The resulting aqueous medium is whitish.

The number and weight average molecular weights and the glass transition temperature of the above-prepared resins are measured as follows.

The number and weight average molecular weights are measured by GPC as follows. First, columns in which tetrahydrofuran is flowing at a flow rate of 1 ml/min is stabilized in a heat chamber at 40° C. Next, 50 to 200 μl of a tetrahydrofuran solution containing 0.05 to 0.6% by weight a resin sample are injected into the columns. The number and weight average molecular weights are calculated from number of counts detected by a refractive index detector with reference to a calibration curve compiled from multiple polystyrene standard samples. The multiple polystyrene standard samples include monodisperse polystyrene samples each having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ (obtainable from Pressure Chemical Company or Tosoh Corporation).

The glass transition temperature is measured using instruments TA-60WS and DSC-60 (from Shimadzu Corporation) as follows. First, 5 mg of a resin sample are contained in an aluminum sample pan with a lid, and subjected to a measurement under 50 ml/min of nitrogen airflow and the following temperature conditions. An empty aluminum sample pan is set as a reference.

Start temperature: 20° C.
Heating rate: 10° C./min
End temperature: 150° C.
Retention time: none
Cooling rate: 10° C./min
End temperature: 20° C.
Retention time: none
Heating rate: 10° C./min
End temperature: 150° C.

The measurement results are analyzed using a data analysis software TA-60 version 1.52 (from Shimadzu Corporation). First, a peak temperature is determined using a peak analysis function of the software by specifying a temperature range ±5° C. from a lowest temperature at which a maximum peak is observed in a DrDSC curve. The DrDSC curve is obtained by differentiate a DSC curve obtained in the second heating. Next, a maximum endothermic temperature, indicating a glass transition temperature, is determined using the peak analysis function of the software by specifying a temperature range ±5° C. from the above-determined peak temperature in the DSC curve.

Example 1

Preparation of Calixarene Dispersion

A beaker is charged with 5 parts of a calixarene (A) having the following formula, 15 parts of the polyester 1, and 30 parts of ethyl acetate:

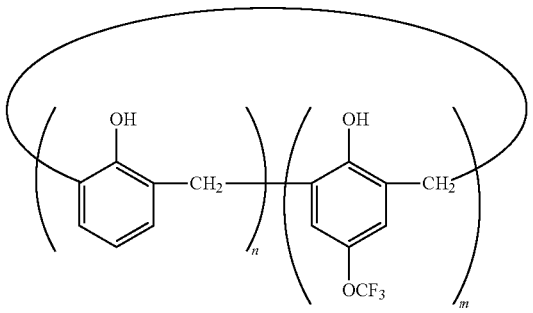

wherein each of n and m represents an integer and the sum of n and m is between 4 to 8.

The mixture in the beaker is then subjected to a dispersion treatment using a bead mill (ULTRAVISCOMILL (trademark) from Aimex Co., Ltd.). The dispersing conditions are as follows.

Liquid feeding speed: 1 kg/hour
Peripheral speed of disc: 6 m/sec
Dispersion media: zirconia beads with a diameter of 0.5 mm
Filling factor of beads: 80% by volume
Repeat number of dispersing operation: 3 times (3 passes)

Thus, a calixarene dispersion is prepared. The calixarene (A) in the dispersion has a volume average particle diameter of 104 nm.

Preparation of First Liquid

First, 100 parts of the polyester 1 are mixed with and dissolved in 130 parts of ethyl acetate in a beaker. Next, 10 parts of a carnauba wax having a molecular weight of 1,800, an acid value of 2.5 mgKOH/g, and a penetration of 1.5 mm at 40° C., 10 parts of the master batch, and 1 part of the calixarene dispersion are further added to the beaker.

The mixture in the beaker is then subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Further, 1 part of isophorone diamine and 40 parts of the polyester prepolymer are successively added to the beaker and the resulting mixture is agitated. Thus, a first dispersion is prepared.

Preparation of Second Liquid

First, 150 parts of the aqueous medium in a vessel is agitated using a TK HOMOMIXER (from PRIMIX Corporation) at a revolution of 12,000 rpm. Next, 100 parts of the first liquid are added thereto, and the mixture is agitated for 10 minutes. Thus, a second liquid is prepared.

Removal of Organic Solvents

A flask equipped with a deaerating tube, a stirrer, and a thermometer is charged with 100 parts of the second liquid. The second liquid in the flask is subjected to organic solvent removal for 12 hours at 30° C. under reduced pressers while being agitated at a peripheral speed of 20 m/min. Thus, a slurry is prepared.

Washing

The slurry is then filtered under reduced pressures, and the resulting cake is mixed with 300 parts of ion-exchange water for 10 minutes using a TK HOMOMIXER (from PRIMIX Corporation) at a revolution of 12,000 rpm. This operation is repeated until the resulting slurry exhibits a conductivity of from 0.1 to 1 μS/cm. Thus, a third liquid is prepared.

Aftertreatment

A flask equipped with a stirrer and a thermometer is charged with the third liquid. The third liquid in the flask is subjected to a heat treatment at 55° C. for 30 minutes while being agitated at a peripheral speed of 20 m/min.

Next, a methanol solution of a charge controlling agent (B) having the following formula in an amount of 0.07% by weight, based on the total weight of solid components in the third liquid, is added to the flask, and the resulting mixture is agitated for 1 hour at room temperature at a peripheral speed of 20 m/min.

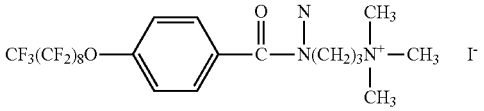

Drying and Classification

The resulting slurry is filtered under reduced pressures and the resulting cake is dried for 48 hours at 45° C. using a fair wind drier. The dried cake is sieved with a mesh having openings of 75 μm. Thus, a mother toner is prepared.

External Treatment

Finally, 100 parts of the mother toner are mixed with 0.6 parts of a hydrophobized silica having an average particle diameter of 100 nm, 1.0 part of a titanium oxide having an average particle diameter of 20 nm, and 0.8 parts of another hydrophobized silica having an average particle diameter of 15 nm using a HENSCHEL MIXER. Thus, a toner 1 is prepared. The relative ion strength of the toner 1 is 0.38.

Example 2

The procedure for preparing the toner 1 in Example 1 is repeated except for changing the amount of the calixarene (A) to 0.1 parts. Thus, a toner 2 is prepared. The relative ion strength of the toner 2 is 0.35.

Example 3

The procedure for preparing the toner 1 in Example 1 is repeated except for changing the amount of the calixarene (A) to 3.0 parts. Thus, a toner 3 is prepared. The relative ion strength of the toner 3 is 0.45.

Example 4

The procedure for preparing the toner 1 in Example 1 is repeated except for changing the amount of the charge controlling agent (B) to 0.04%. Thus, a toner 4 is prepared. The relative ion strength of the toner 4 is 0.14.

Example 5

The procedure for preparing the toner 1 in Example 1 is repeated except for changing the amount of the charge controlling agent (B) to 0.1%. Thus, a toner 5 is prepared. The relative ion strength of the toner 5 is 0.24.

Example 6

The procedure for preparing the toner 1 in Example 1 is repeated except that the third liquid in the flask is subjected to the heat treatment at 55° C. for 30 minutes while being agitated at a peripheral speed of 20 m/min, after the methanol solution of the charge controlling agent (B) in an amount of 0.07% by weight, based on the total weight of solid components in the third liquid, is added thereto and the resulting mixture is agitated for 1 hour at room temperature at a peripheral speed of 20 m/min. Thus, a toner 6 is prepared. The relative ion strength of the toner 6 is 0.44.

Example 7

The procedure for preparing the toner 1 in Example 1 is repeated except for replacing the calixarene (A) with another calixarene having the following formula:

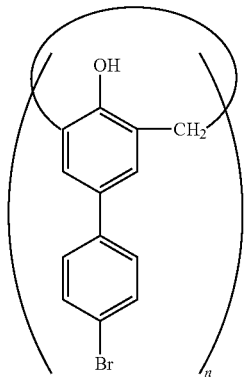

wherein n represents an integer between 4 to 8. Thus, a toner 7 is prepared. The relative ion strength of the toner 7 is 0.35.

Comparative Example 1

The procedure for preparing the toner 1 in Example 1 is repeated except for replacing the calixarene (A) with another calixarene having the following formula:

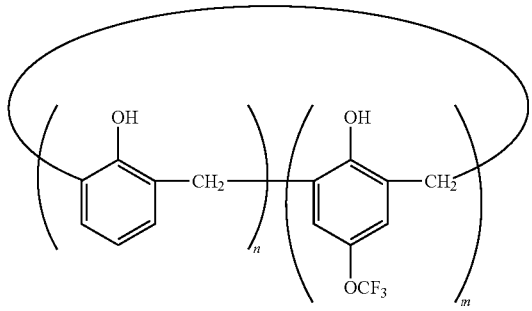

wherein each of n and m represents an integer and the sum of n and m is between 4 to 8. Thus, a comparative toner 1 is prepared. The relative ion strength of the comparative toner 1 is 0.34.

Comparative Example 2

The procedure for preparing the toner 1 in Example 1 is repeated except for replacing the calixarene (A) with another calixarene having the following formula:

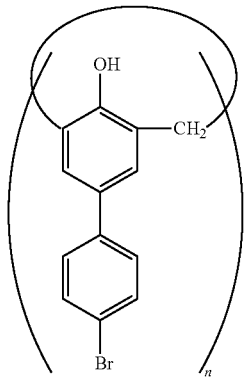

wherein n represents an integer between 4 to 8. Thus, a comparative toner 2 is prepared. The relative ion strength of the comparative toner 2 is 0.35.

Comparative Example 3

The procedure for preparing the toner 1 in Example 1 is repeated except that the charge controlling agent (B) is not added. Thus, a comparative toner 3 is prepared. The relative ion strength of the comparative toner 3 is 0.11.

Comparative Example 4

The procedure for preparing the toner 1 in Example 1 is repeated except for changing the amount of the charge controlling agent (B) to 0.2%. Thus, a comparative toner 4 is prepared. The relative ion strength of the comparative toner 4 is 0.51.

Comparative Example 5

The procedure for preparing the toner 1 in Example 1 is repeated except that both the calixarene (A) and the charge controlling agent (B) are not added. Thus, a comparative toner 5 is prepared. The relative ion strength of the comparative toner 5 is 0.

Preparation of Carrier

First, 21 parts of an acrylic resin solution containing 50% by weight of solid components, 6.4 parts of a guanamine solution containing 70% by weight of solid components, 7.6 parts of alumina particles having an average particle diameter of 0.3 μm and a volume resistivity of $1\times10^{14}$ Ω·cm, 65 parts of a silicone resin solution SR2410 (from Dow Corning Toray Co., Ltd.) containing 23% by weight of solid components, 1.0 parts of an aminosilane SH6020 (from Dow Corning Toray Co., Ltd.), 60 parts of toluene, and 60 parts of butyl cellosolve are mixed and dispersed for 10 minutes using a HOMOMIXER. Thus, a coating liquid is prepared.

Next, the coating liquid is coated on a calcined ferrite powder $(MgO)_{1.8}(MnO)_{49.5}(Fe_2O_3)_{48.0}$ having an average particle diameter of 25 μm using a coater SPIRA COTA® (from Okada Seiko Co., Ltd.), followed by drying. The coated ferrite powder is then calcined in an electric furnace for 1 hour at 150° C., followed by cooling, and then sieved with a mesh having openings of 106 μm. Thus, a carrier is prepared. The carrier has a weight average particle diameter of 35 μm and the coated layer has an average thickness of 0.15 μm.

The average thickness of the coated layer is measured by observing a cross section of the carrier using a transmission electron microscope.

The weight average particle diameter is measured using a Microtrac particle size analyzer HRA9320-X100 (from Microtrac). During the measurement, the measuring particle diameter range is set to between 8 and 100 μm, the channel width is set to 2 μm, the number of channels is set to 46, and the refractive index is set to 2.42.

Preparation of Developer

A developer is prepared by mixing 100 parts of the carrier with 7 parts of each of the above-prepared toners using a mixer TURBULA®.

Evaluations

The developers are subjected to the following evaluations of chargeability, durability, and environmental stability.

(1) Chargeability

A saturated charge amount of each toner is measured using a V-blowoff instrument (from Ricoh Souzou Kaihatsu) as follows. First, 6 g of each developer is left in a normal temperature and normal humidity condition (20° C., 65% RH) for 2 hours. The developer is then contained in a metallic gauge and agitated for 600 seconds at a revolution of 285 rpm using an agitation device, and thereafter 1 g of the developer is subjected to a single mode measurement to determine charge distribution of the toner. In the single mode measurement, the measurement height is set to 5 mm, the suction value is set to 100, and the number of blowoff is set to 2. As a mesh, a 635 mesh is in use.

The measurement results are graded as follows.

Good: Saturated charge amount is less than −30 μC/g.

Average: Saturated charge amount is −30 μC/g or more and less than −20 μC/g.

Poor: Saturated charge amount is −20 μC/g or more and less than 0 μC/g.

(2) Durability

An image forming apparatus DocuColor 8000 Digital Press (from Fuji Xerox Co., Ltd.) is modified so that the linear speed and the transfer time are variable. Each developer is set in the above image forming apparatus, and 100,000 sheets of an A4-size solid image having 0.6 mg/cm$^2$ of toner are produced. Thereafter, 1 g of the developer is taken out and subjected to the above-described single mode measurement to determine charge distribution of the toner.

Durability is evaluated by comparing the saturated charge amounts measured in the above evaluation (1) and the present evaluation (2), and graded as follows.

Good: The difference in saturated charge amount between (1) and (2) is 0 μC/g or more and less than 5 μC/g.

Average: The difference in saturated charge amount between (1) and (2) is 5 μC/g or more and less than 10 μC/g.

Good: The difference in saturated charge amount between (1) and (2) is 10 μC/g or more.

(3) Environmental Stability

The procedure in the above (1) is repeated except for changing the normal temperature and normal humidity condition (20° C., 65% RH) to a high temperature and high humidity condition (40° C., 90% RH) or a low temperature and low humidity condition (10° C., 15% RH).

Environmental stability is evaluated by comparing the saturated charge amounts measured in the above evaluation (1) and the present evaluation (3), and graded as follows.

Good: The difference in saturated charge amount between (1) and (3) is 0 μC/g or more and less than 5 μC/g.

Average: The difference in saturated charge amount between (1) and (3) is 5 μC/g or more and less than 10 μC/g.

Good: The difference in saturated charge amount between (1) and (3) is 10 μC/g or more.

The results of the above evaluations are shown in Tables 1 and 2.

TABLE 1

| | Charge amount (μC/g) | | | |
|---|---|---|---|---|
| | NN condition | | LL | HH |
| | Initial | After printing 100,000 sheets | condition Initial | condition Initial |
| Example 1 | −40 | −38 | −44 | −35 |
| Example 2 | −31 | −31 | −36 | −26 |
| Example 3 | −45 | −44 | −49 | −39 |
| Example 4 | −35 | −38 | −38 | −30 |
| Example 5 | −44 | −38 | −49 | −39 |
| Example 6 | −37 | −38 | −41 | −32 |
| Example 7 | −61 | −56 | −66 | −57 |
| Comparative Example 1 | −25 | −23 | −32 | −19 |

TABLE 1-continued

| | Charge amount (μC/g) | | | |
|---|---|---|---|---|
| | NN condition | | LL | HH |
| | Initial | After printing 100,000 sheets | condition Initial | condition Initial |
| Comparative Example 2 | −38 | −37 | −44 | −37 |
| Comparative Example 3 | −30 | −38 | −33 | −26 |
| Comparative Example 4 | −52 | −40 | −59 | −43 |
| Comparative Example 5 | −14 | −3 | −25 | −1 |

NN: Normal temperature and normal humidity condition
LL: Low temperature and low humidity condition
HH: High temperature and high humidity condition

TABLE 2

| | (1) Chargeability | (2) Durability | (3) Environmental stability | |
|---|---|---|---|---|
| | | | LL condition | HH condition |
| Example 1 | Good | Good | Good | Average |
| Example 2 | Good | Good | Average | Average |
| Example 3 | Good | Good | Good | Average |
| Example 4 | Good | Good | Good | Average |
| Example 5 | Good | Average | Average | Average |
| Example 6 | Good | Good | Good | Average |
| Example 7 | Good | Average | Average | Good |
| Comparative Example 1 | Average | Good | Average | Average |
| Comparative Example 2 | Good | Good | Average | Good |
| Comparative Example 3 | Average | Average | Good | Good |
| Comparative Example 4 | Good | Poor | Average | Average |
| Comparative Example 5 | Poor | Poor | Poor | Poor |

Table 2 shows that the Example toners have good chargeability, durability, and environmental stability.

Additional modifications and variations of the present invention are possible in light of the above teachings. It is therefore to be understood that within the scope of the appended claims the invention may be practiced other than as specifically described herein.

What is claimed is:

1. A toner, comprising:

a mother toner comprising a binder resin and a calixarene having a halogen group; and a charge controlling agent having a halogen group that is present on a surface of the mother toner, wherein a ratio of halogen ion to carbon ion on a surface of the toner is from 0.01 to 0.5, said ratio determined from number of counts measured by time-of-flight secondary ion mass spectroscopy.

2. The toner according to claim 1, wherein the binder resin includes one or both of a polyester and a modified polyester that is a reaction product of a compound having an active hydrogen group with a polyester prepolymer having a functional group reactive with the active hydrogen group.

3. A method of manufacturing the toner according to claim 1, comprising:

preparing a first liquid by dissolving or dispersing toner components in an organic solvent, said toner components including the calixarene having a halogen group and one or both of the binder resin and a precursor of the binder resin;

preparing a second liquid by emulsifying or dispersing the first liquid in an aqueous medium;

removing the organic solvent from the second liquid;

preparing a third liquid by washing the second liquid from which the organic solvent is removed; and adding the charge controlling agent having a halogen group to the third liquid.

4. The method of manufacturing toner according to claim 3, further comprising heating the third liquid after adding the charge controlling agent having a halogen group thereto.

5. The method of manufacturing toner according to claim 4, wherein the third liquid is heated to a temperature between 10° C. lower and 10° C. higher than a glass transition temperature of the binder resin.

6. The method of manufacturing toner according to claim 3, further comprising heating the third liquid before adding the charge controlling agent having a halogen group thereto.

7. The method of manufacturing toner according to claim 6, wherein the third liquid is heated to a temperature between 10° C. lower and 10° C. higher than a glass transition temperature of the binder resin.

8. The method of manufacturing toner according to claim 3, wherein the precursor includes a polyester prepolymer having a functional group reactive with an active hydrogen group.

9. A developer, comprising the toner according to claim 1.

10. An image forming method, comprising:

charging a photoreceptor;

emitting light onto the charged photoreceptor to form an electrostatic latent image thereon;

developing the electrostatic latent image into a toner image with toner; and transferring the toner image from the photoreceptor onto a recording material, wherein the toner includes:

a mother toner comprising a binder resin and a calixarene having a halogen group; and a charge controlling agent having a halogen group that is present on a surface of the mother toner, wherein a ratio of halogen ion to carbon ion on a surface of the toner is from 0.01 to 0.5, said ratio determined from number of counts measured by time-of-flight secondary ion mass spectroscopy.

11. The image forming method according to claim 10, wherein the transferring further comprises:

transferring the toner image from the photoreceptor onto an intermediate transfer member; and transferring the toner image from the intermediate transfer member onto the recording material.

12. The image forming method according to claim 11, wherein the toner is transferred from the intermediate transfer member onto the recording material at a linear speed of from 0.1 to 1 m/sec within a transfer time of from 0.5 to 60 msec.

13. The toner of claim 1, wherein the calixarene having a halogen group includes a calixarene having p-trifluoromethoxy group and/or a calixarene having p-bromophenyl group.

14. The image forming method of claim 10, wherein the calixarene having a halogen group includes a calixarene having p-trifluoromethoxy group and/or a calixarene having p-bromophenyl group.

15. The toner of claim 13, wherein the calixarene having a halogen group includes at least one of the following compounds (a) and (b)

(a)

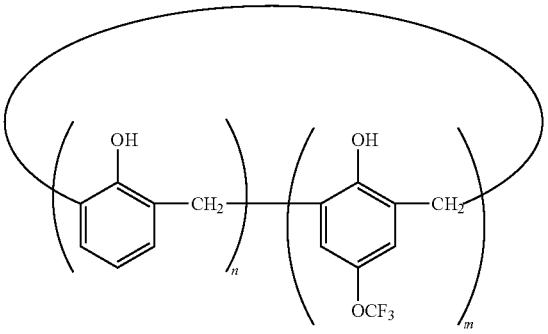

(b)

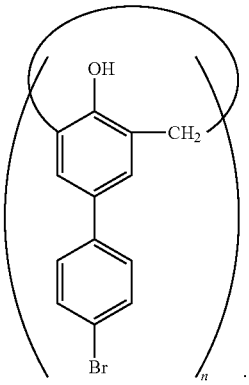

16. The image forming method of claim 14, wherein the calixarene having a halogen group includes the following compounds (a) and/or (b)

(a)

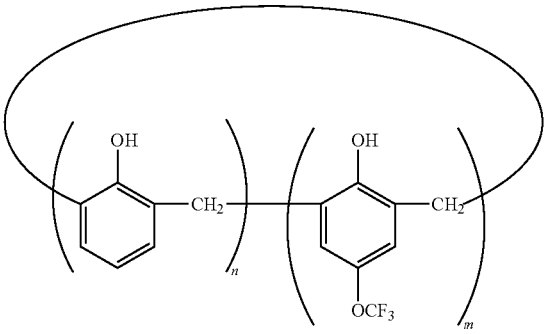

(b)

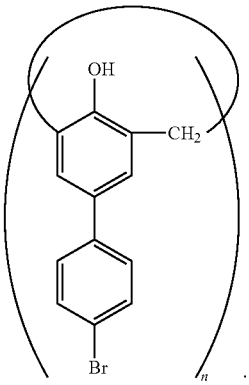

17. The toner of claim 1, wherein the charge controlling agent having a halogen group comprises the following compound (c)
(c)
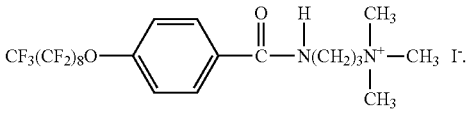
18. The image forming method of claim 10, wherein the charge controlling agent having a halogen group comprises the following compound (c)
(c)
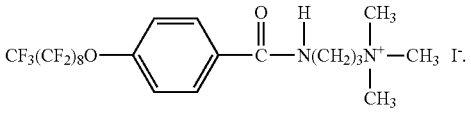
* * * * *